US010865593B2

(12) United States Patent
Doherty

(10) Patent No.: US 10,865,593 B2
(45) Date of Patent: Dec. 15, 2020

(54) DOOR GUARD ASSEMBLY

(71) Applicant: Patrick John Doherty, Littleborough (GB)

(72) Inventor: Patrick John Doherty, Littleborough (GB)

( * ) Notice: Subject to any disclaimer, the term of this patent is extended or adjusted under 35 U.S.C. 154(b) by 795 days.

(21) Appl. No.: 14/427,289

(22) PCT Filed: Sep. 11, 2013

(86) PCT No.: PCT/GB2013/052375
§ 371 (c)(1),
(2) Date: Mar. 10, 2015

(87) PCT Pub. No.: WO2014/041347
PCT Pub. Date: Mar. 20, 2014

(65) Prior Publication Data

US 2015/0240540 A1 Aug. 27, 2015

(30) Foreign Application Priority Data

Sep. 12, 2012 (GB) ..... 1216222.8
Feb. 21, 2013 (GB) ..... 1303042.4

(51) Int. Cl.
*E05C 17/48* (2006.01)
*E05C 17/04* (2006.01)
(Continued)

(52) U.S. Cl.
CPC ..... *E05C 17/48* (2013.01); *E05C 17/04* (2013.01); *E05C 17/30* (2013.01); *E05C 17/365* (2013.01);
(Continued)

(58) Field of Classification Search
CPC ..... E05C 17/02; E05C 17/04; E05C 17/045; E05C 17/12; E05C 17/14; E05C 17/16;
(Continued)

(56) References Cited

U.S. PATENT DOCUMENTS 198,553 A * 12/1877 Von Auer ..... E05C 17/365 292/264
341,025 A * 5/1886 Letzing ..... E05C 17/365 70/93

(Continued)

FOREIGN PATENT DOCUMENTS

DE 577406 10/1935
ES 2277494 7/2007

(Continued)

OTHER PUBLICATIONS

International Search Report and Written Opinion for PCT/GB2013/052375.

*Primary Examiner* — Alyson M Merlino
(74) *Attorney, Agent, or Firm* — Renner, Otto, Boisseile & Sklar, LLP

(57) ABSTRACT

A door guard assembly is provided comprising: a first part that is attachable to a door; a second part that is attachable to a door frame; an elongate member; a slidable plate that comprises a receiving means; wherein the first part and/or the second part and/or the elongate member further comprise (s) a dampening means; and, wherein the elongate member is attached to the first part or the second part and in use can be engaged with the receiving means of the plate located on the other first or second part respectively when the plate is slid into an operating position such that the receiving means engages the outer surface of the elongate member as the door is opened and the receiving means and elongate member thus limit the opening of the door, and the dampening means absorbs an impact force that may be applied to the door whose opening has been limited in this way.

16 Claims, 17 Drawing Sheets

(51) Int. Cl.

| | |
|---|---|
| ***E05C 17/36*** | (2006.01) |
| ***E05C 17/30*** | (2006.01) |
| *E05B 15/04* | (2006.01) |
| *E05B 17/00* | (2006.01) |
| *E05C 17/16* | (2006.01) |

(52) U.S. Cl.
CPC ..... *E05B 15/04* (2013.01); *E05B 17/0041* (2013.01); *E05C 17/166* (2013.01); *Y10T 292/31* (2015.04)

(58) Field of Classification Search
CPC ..... E05C 17/166; E05C 17/18; E05C 17/20; E05C 17/24; E05C 17/28; E05C 17/46; E05C 17/48; E05C 17/50; E05C 17/00; E05C 17/30; E05C 17/365; Y10T 292/20; Y10T 292/228; Y10T 292/28; Y10T 292/283; Y10T 292/285; Y10T 292/286; Y10T 292/289; Y10T 292/291; Y10T 292/2935; Y10T 292/294; Y10T 292/297; Y10T 292/299; Y10T 292/304; Y10T 292/305; Y10T 292/087; Y10T 292/0872; Y10T 292/0875; Y10T 70/5164; Y10S 292/44; Y10S 292/61; Y10S 292/15; Y10S 292/65; E05B 15/04; E05B 17/0041
See application file for complete search history.

(56) References Cited

U.S. PATENT DOCUMENTS 523,736 A 7/1894 Cazin
654,723 A * 7/1900 Franks ..... E05C 17/22 292/262
797,562 A 8/1905 Crofford
1,038,752 A * 9/1912 Hofbauer ..... E05C 17/166 292/269
1,122,199 A 12/1914 Gadbois
1,371,518 A * 3/1921 Reznicek ..... E05C 17/166 292/262
1,388,712 A * 8/1921 Hoffman ..... E05C 17/166 292/262
1,400,315 A * 12/1921 Reed ..... E05C 17/04 292/278
1,413,473 A * 4/1922 Gorowitz ..... E05C 17/166 292/277
1,645,352 A * 10/1927 Sakalian ..... E05C 17/20 292/262
1,722,355 A * 7/1929 Ritterson ..... E05C 17/166 292/269
1,958,029 A * 5/1934 Ballwanz ..... E05C 17/20 292/273
2,180,578 A * 11/1939 Bradshaw ..... E05C 17/04 292/272
2,200,627 A 5/1940 Levy et al.
2,407,900 A * 9/1946 Irving ..... E05C 17/32 292/263
2,834,627 A * 5/1958 Sullivan ..... E05C 17/04 292/274
2,919,945 A * 1/1960 Tannen ..... E05C 17/166 292/262
3,869,886 A * 3/1975 Diaz ..... E05C 17/04 292/262
4,062,577 A * 12/1977 Butterfield ..... E05C 17/50 292/262
4,126,342 A * 11/1978 Harley ..... E05C 17/166 292/269
4,226,453 A * 10/1980 Robertson ..... E05C 17/166 292/268
4,229,030 A * 10/1980 Tarragona Corbella ..... E05C 17/166 292/270
4,391,463 A * 7/1983 Costa Bastart ..... E05C 17/32 292/263
4,648,641 A * 3/1987 Foster ..... E05C 17/365 292/264
4,648,642 A 3/1987 Berich
4,762,351 A * 8/1988 Bowman ..... E05C 17/32 292/263
4,929,004 A * 5/1990 Chidester ..... E05C 17/50 292/267
5,048,880 A * 9/1991 Narazaki ..... E05C 17/04 292/262
5,647,233 A * 7/1997 Chung ..... E05C 17/365 292/264
2007/0029817 A1 * 2/2007 Svensson ..... E05C 17/04 292/262

FOREIGN PATENT DOCUMENTS

| | | |
|---|---|---|
| GB | 823248 | 11/1959 |
| GB | 1260284 | 1/1972 |
| GB | 2114206 | 8/1983 |
| GB | 2149449 | 6/1985 |
| GB | 2306555 | 5/1987 |
| WO | 2004/083576 | 9/2004 |

* cited by examiner a1
6a
7
4
4
2
7
6b
b1
14
15
11

13
12
12
17
16
18
19

16
11
12
2
20 a
10bi
15a
14a
A
22a
36d
36a
34

16
9
8a
10b
30
1b
10bi
b
22a
9
23
34
36
20
36
35
36d
37
'y'
30
9
31
31
47
32
A

FIG 12
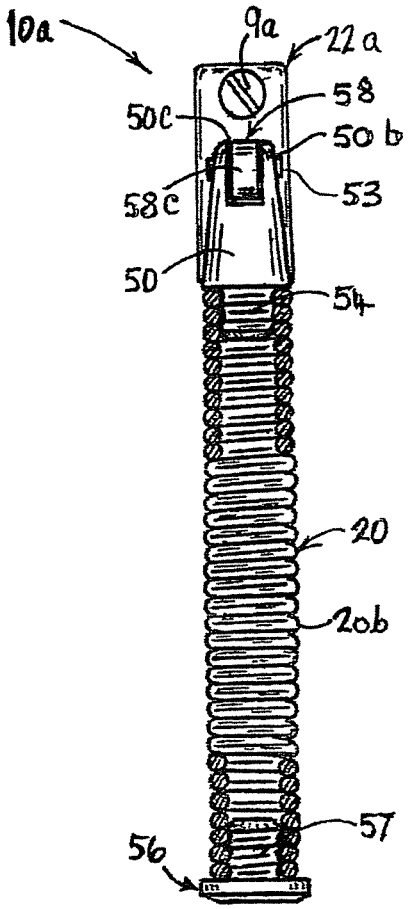
FIG 13
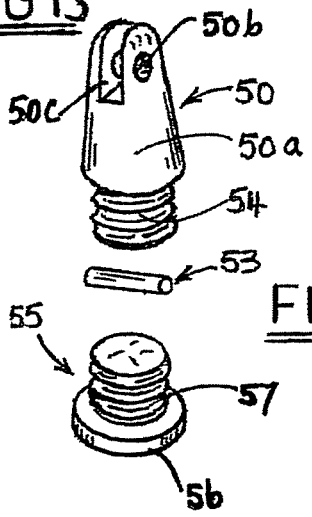
FIG 14
FIG15
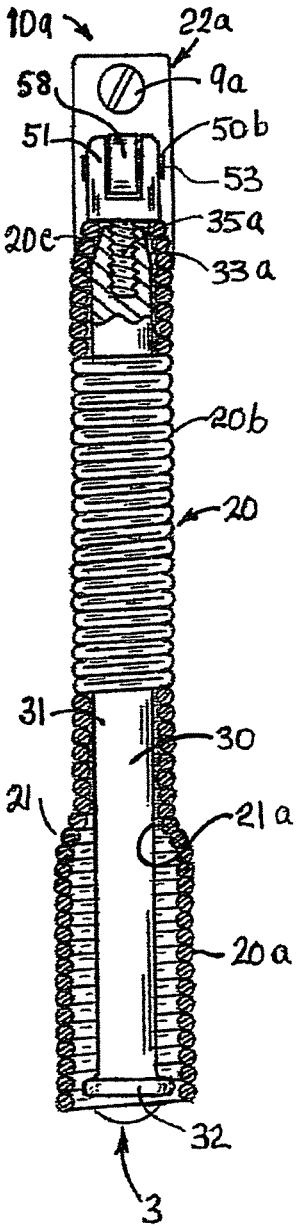
FIG16
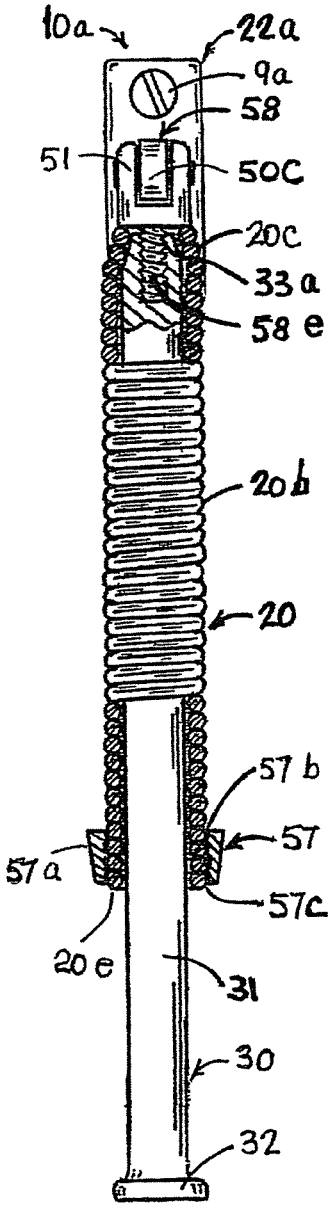
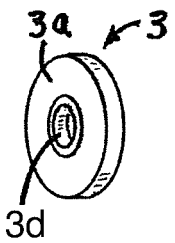
FIG17

FIG 18
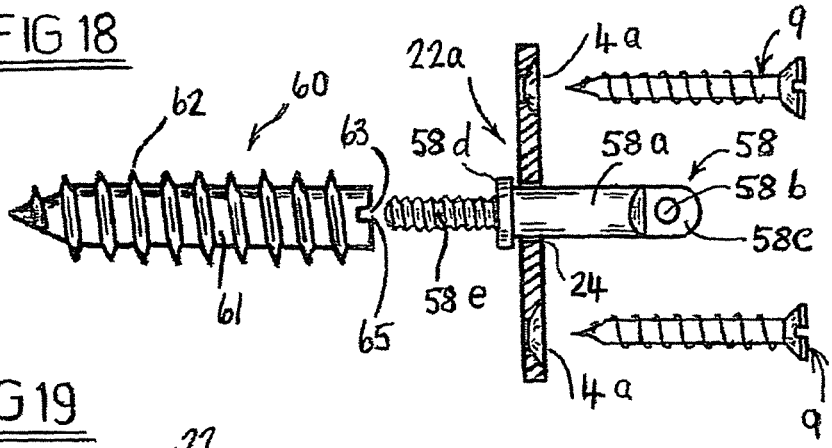
FIG 19
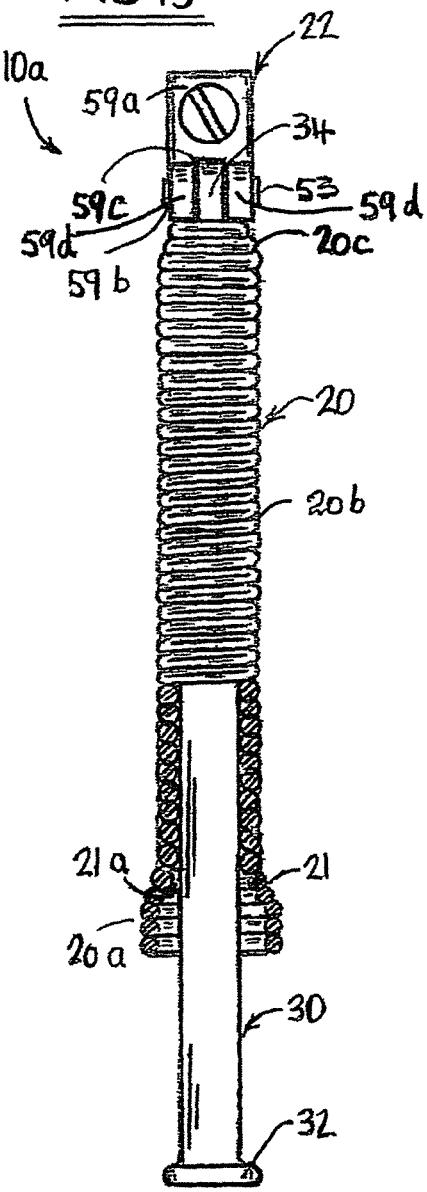
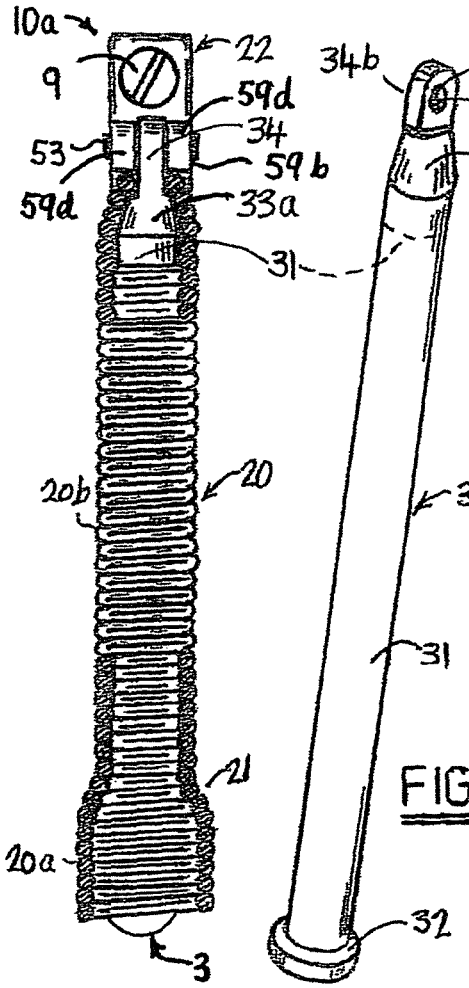
FIG 20
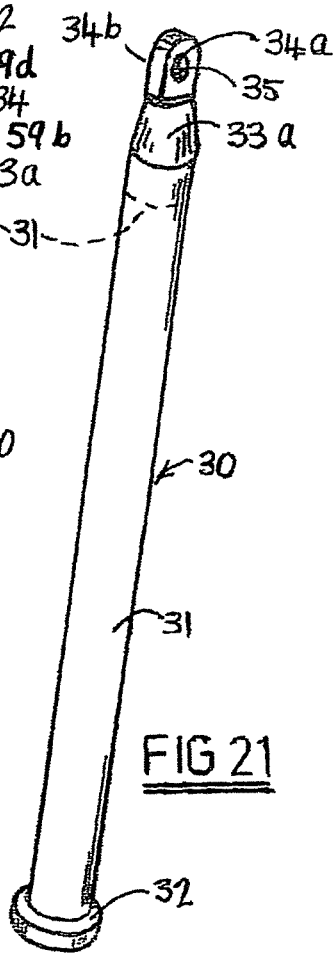
FIG 21

FIG 22
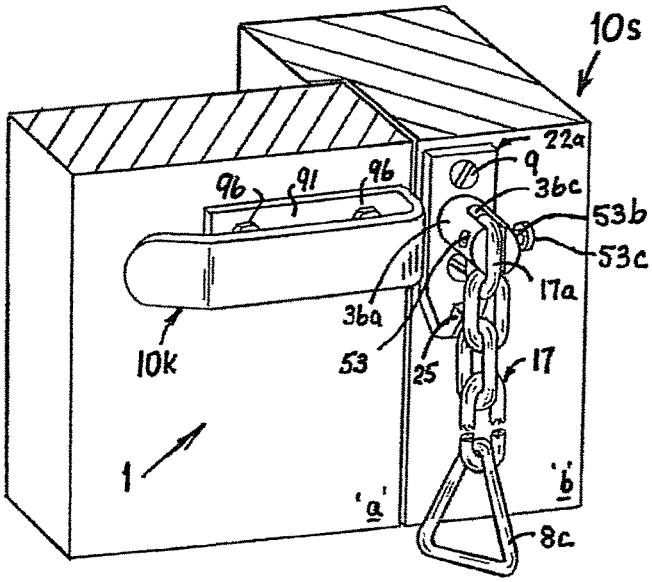
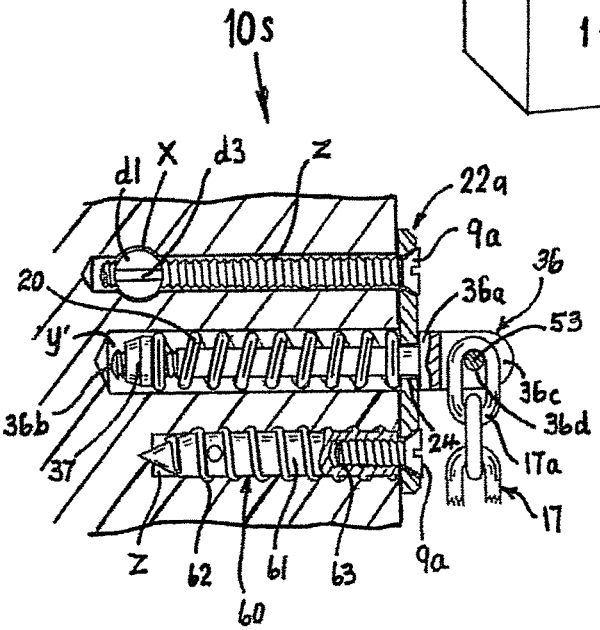
FIG 23
FIG 24
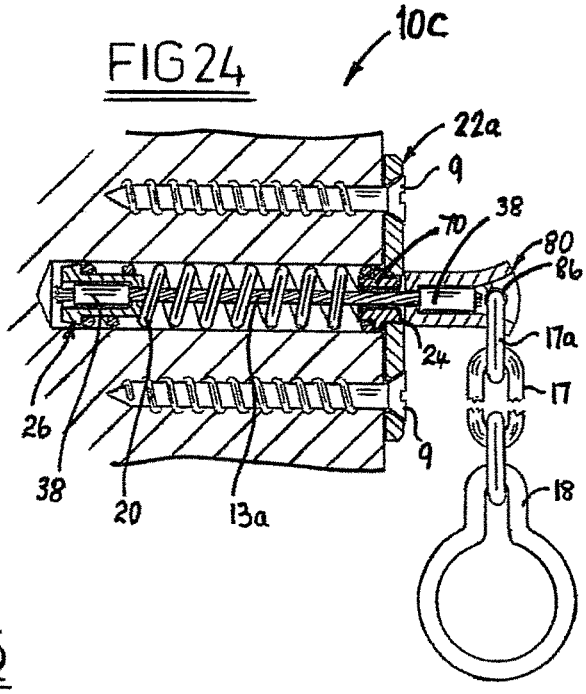
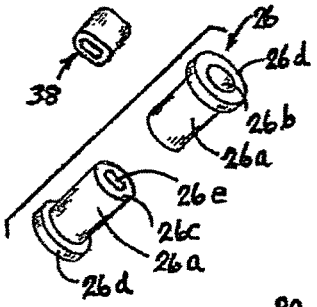
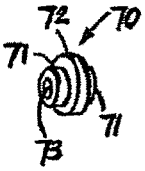
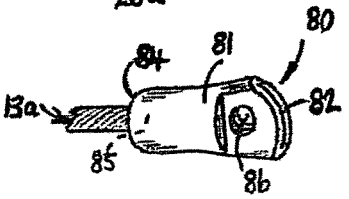
FIG 25

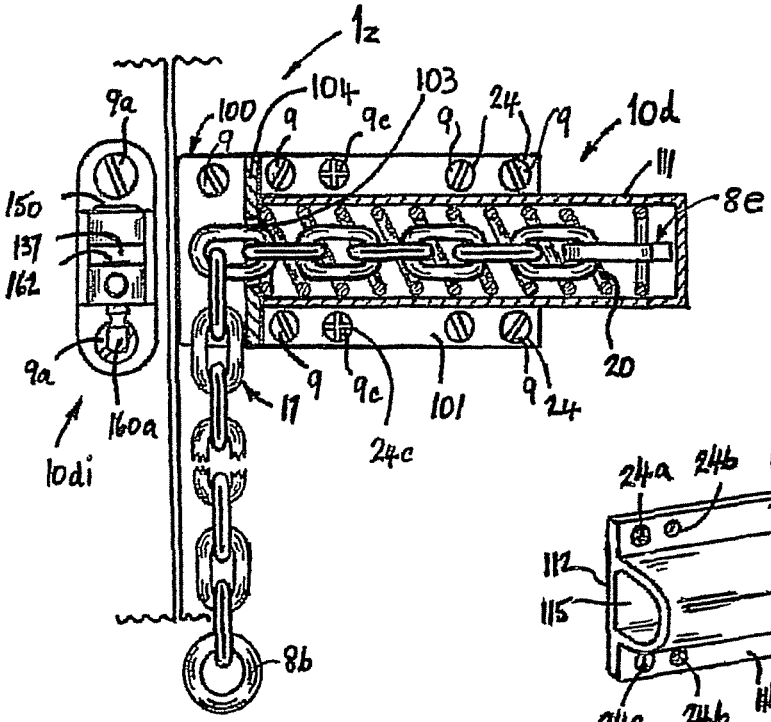
FIG 26
FIG 27
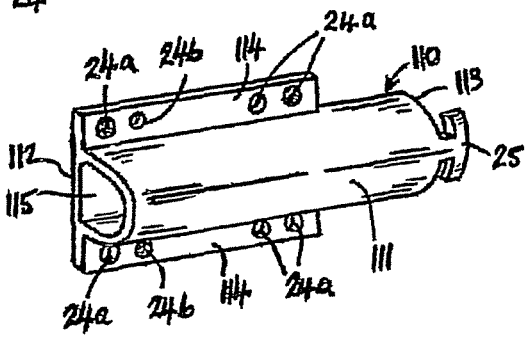
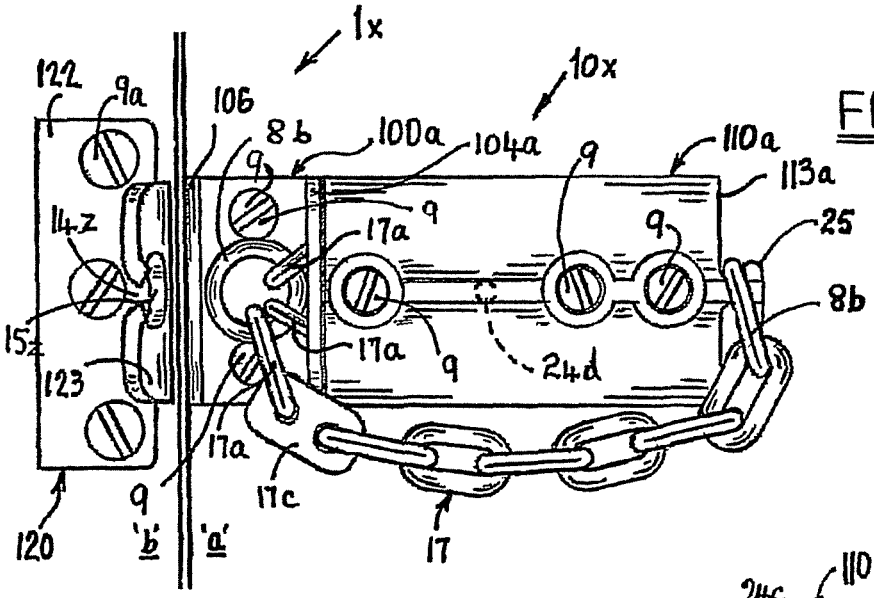
FIG 28
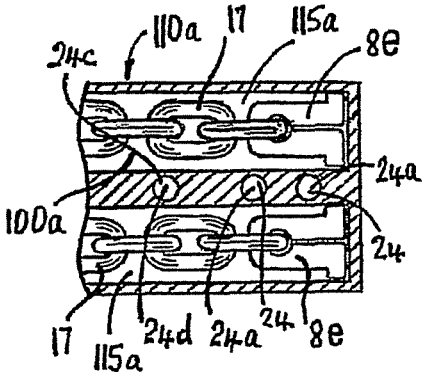
FIG 29

FIG30
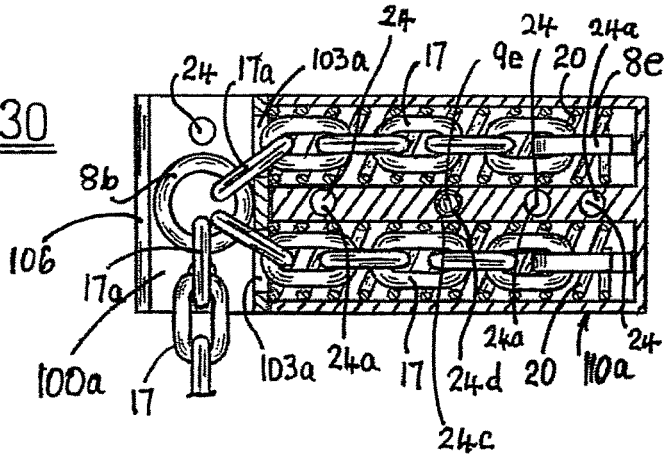
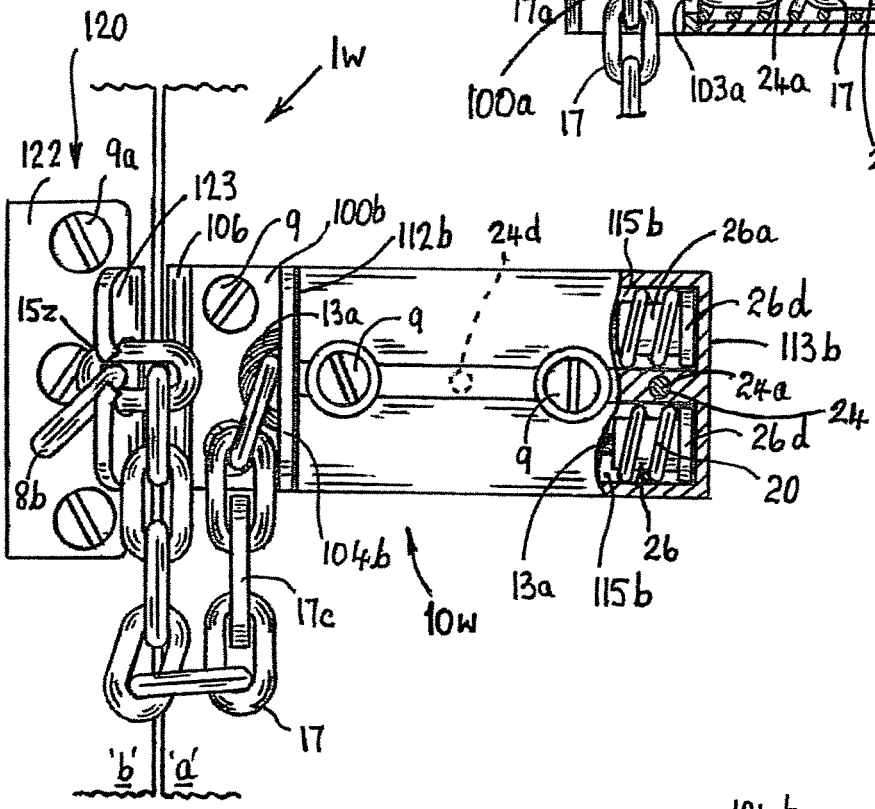
FIG31
FIG32
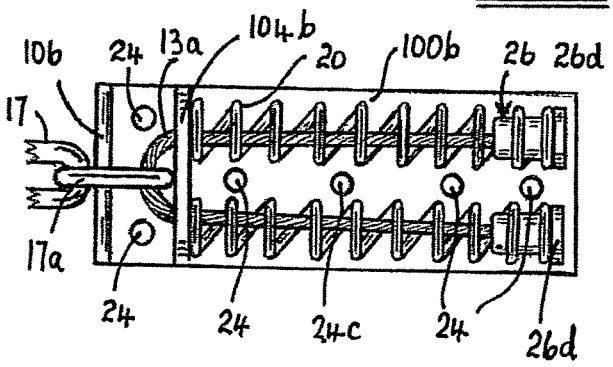
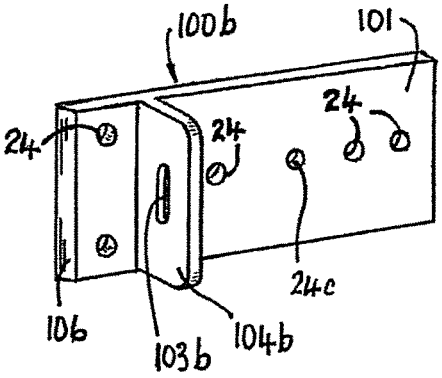
FIG33

FIG 42
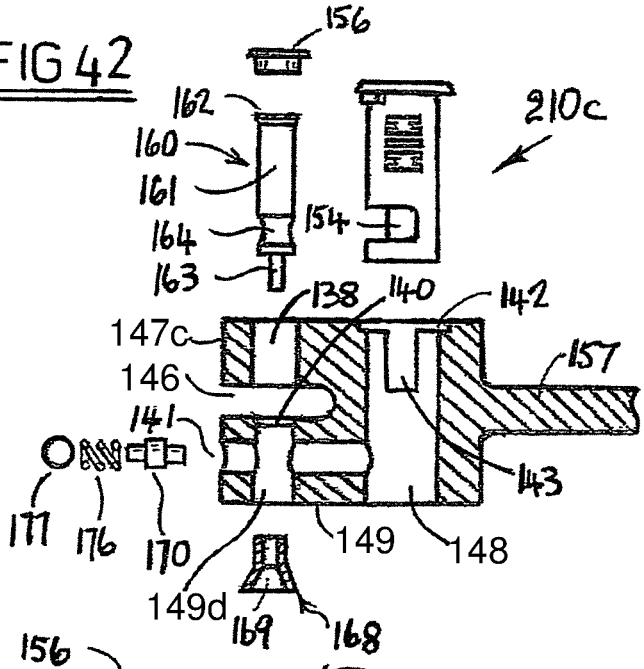
FIG 44
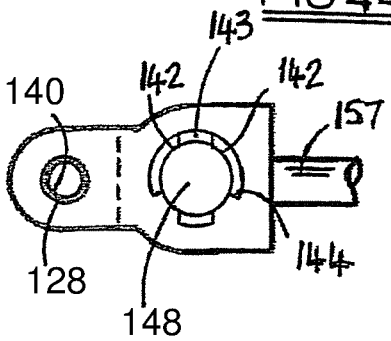
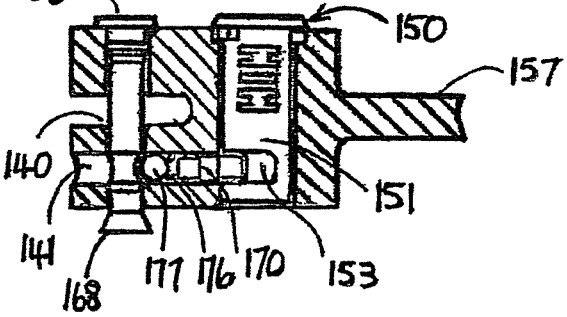
FIG 43
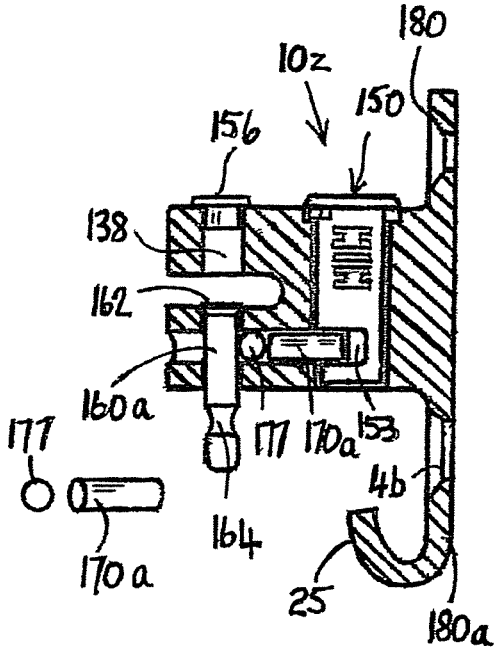
FIG 46
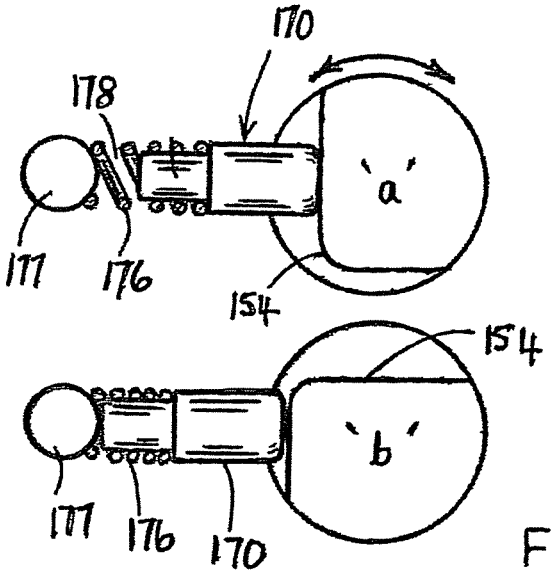
FIG 45

FIG47
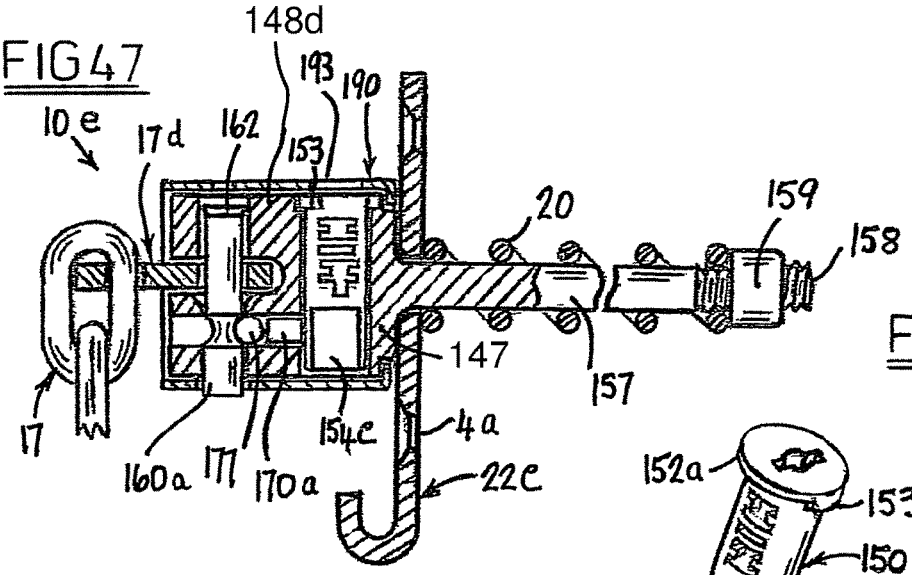
FIG48
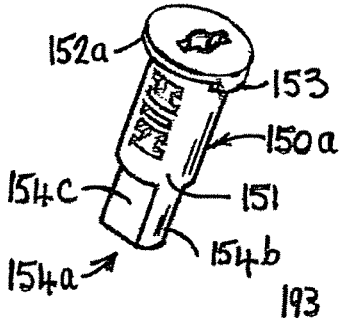
FIG49
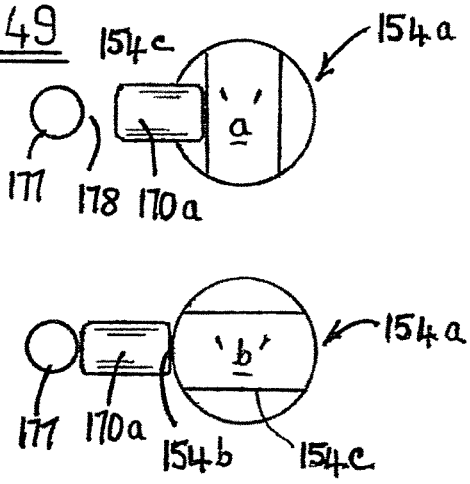
FIG50
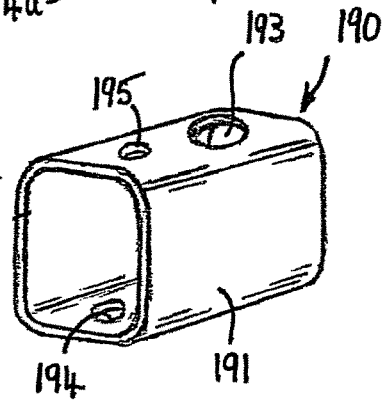
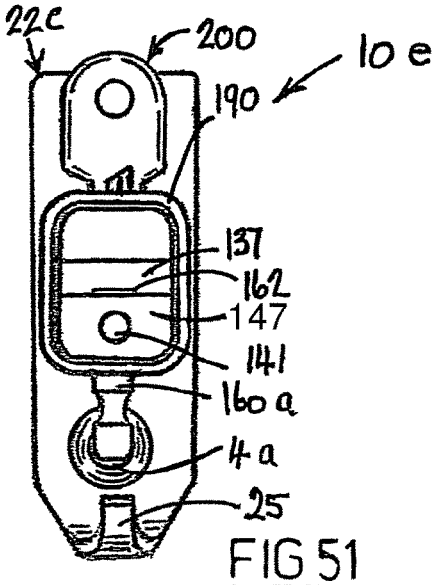
FIG51
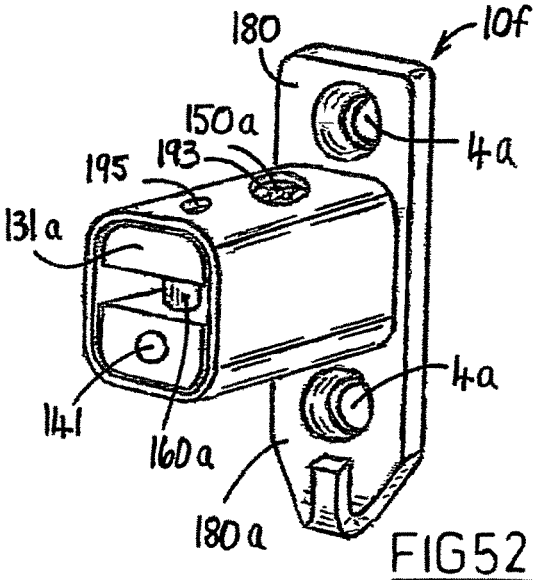
FIG52

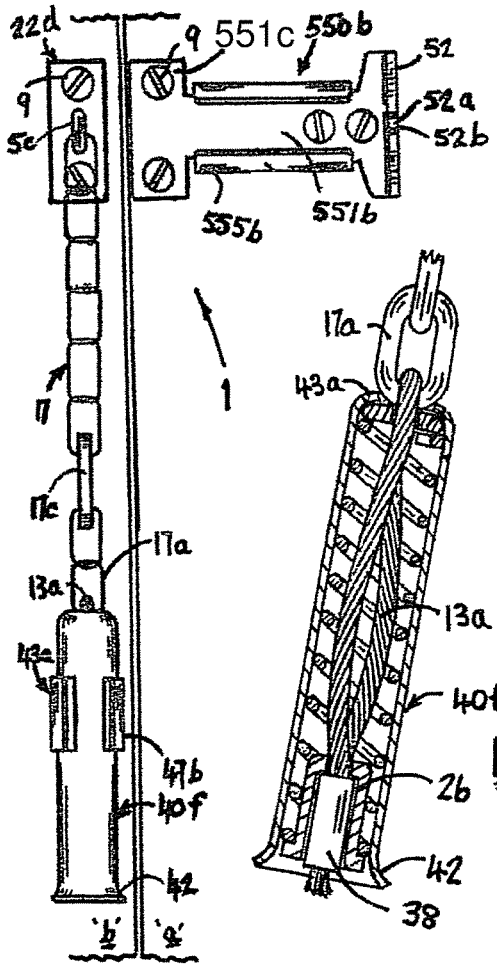
FIG 55
FIG 56
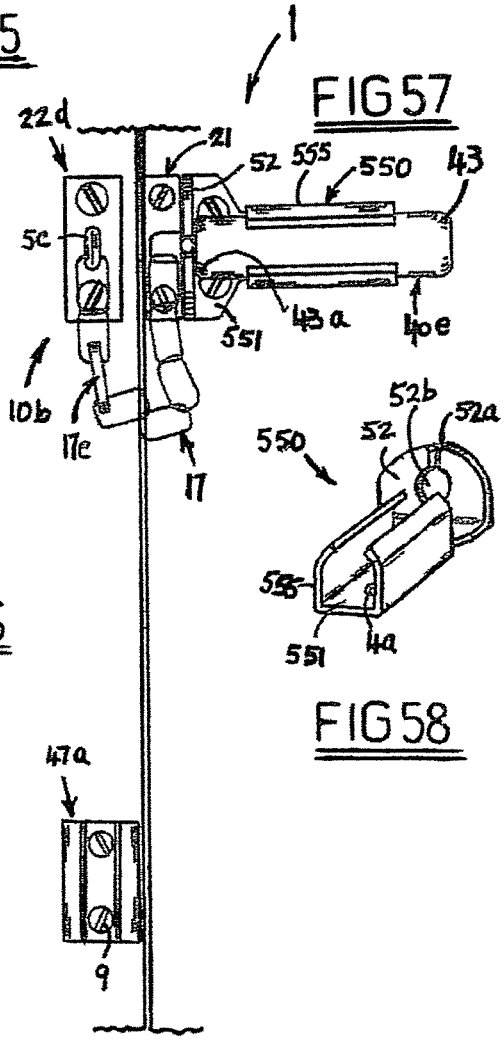
FIG 57
FIG 58
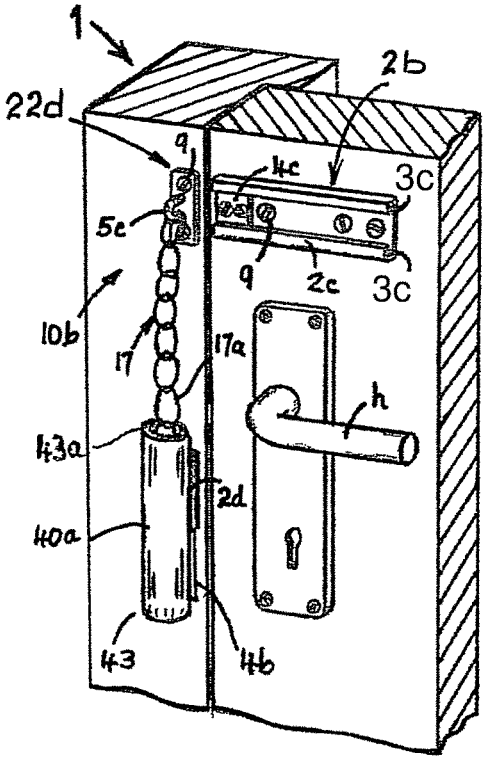
FIG 59

FIG62
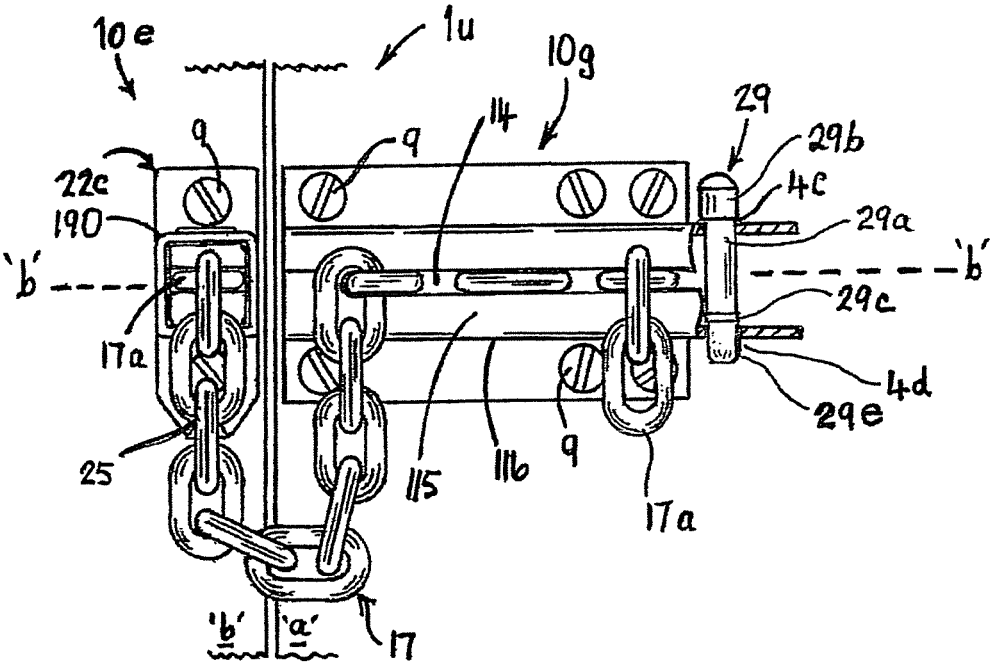
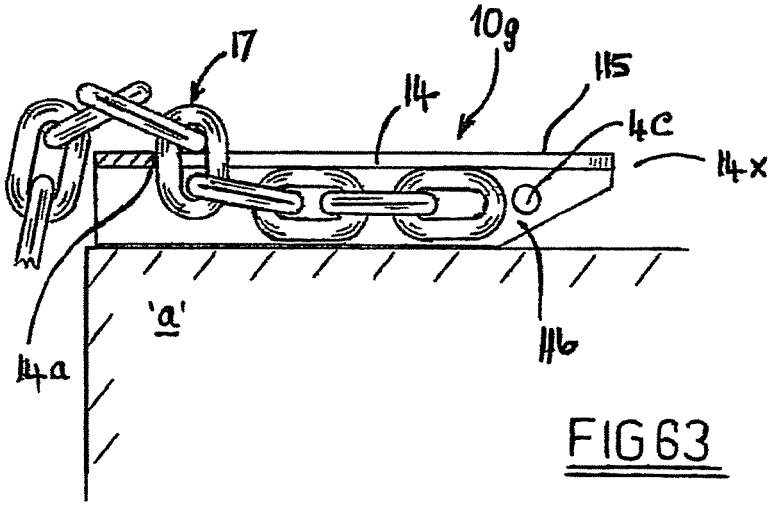
FIG63

FIG64
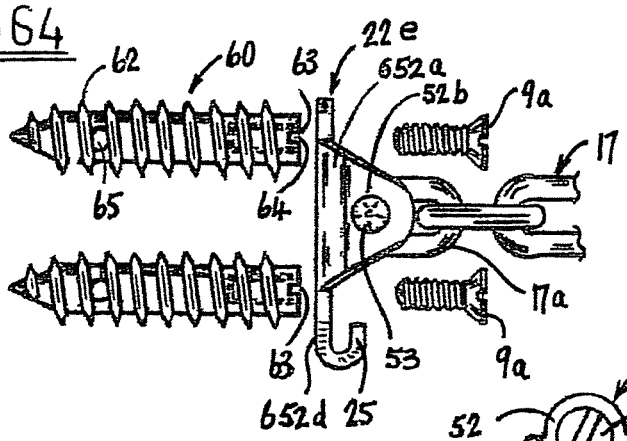
FIG65
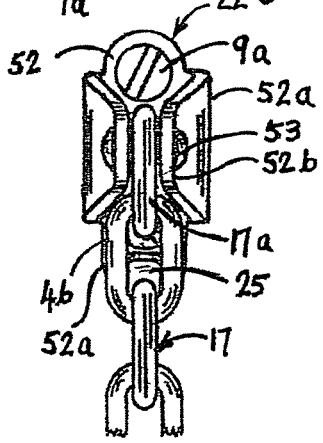
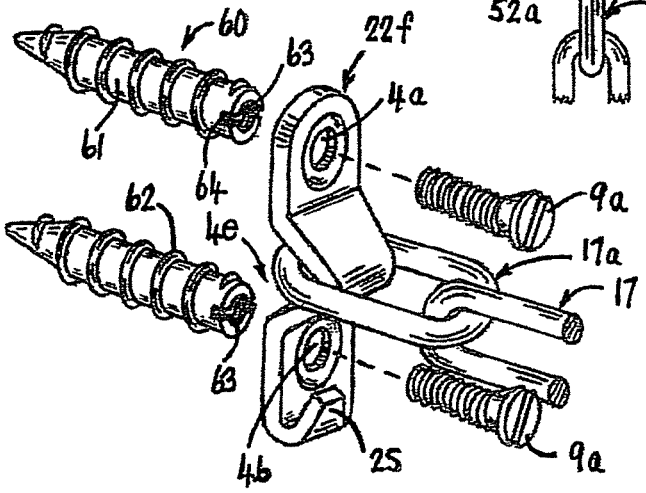
FIG66
FIG67
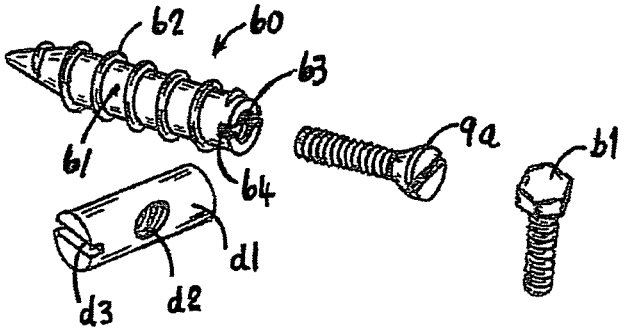

DOOR GUARD ASSEMBLY

The present invention relates to door guard assemblies which in use can be operably connected to a hinged door and its frame to permit limited opening of the door, thus preventing unwanted entry of the door by third parties.

Door guard assemblies are locking devices that are generally referred to as door chains or door security devices, and they usually comprise a short length of chain, one end of the chain is secured to an anchor plate that is rigidly attached to a door frame and the other end of the chain being releasably engagable with a guard plate, said guard plate being rigidly attached to the door associated with the door frame. In use, the device allows the door to be opened a limited distance to confirm the identity of the caller, but prevents unwanted entry by the caller whilst the chain is engaged with the door guard plate and the door is partially opened. If required the free end of the chain may be disengaged from the guard plate allowing the door to be opened fully.

Although the existing devices offer a degree of security, there are shortfalls associated with the existing chain door guards that are commercially available to consumers. For instance, resistance of these devices to an attack by would-be intruder, when the device is in use, rely on the strength and integrity of the anchor points on the door and door frame which are conventionally secured with woodscrews. It is well known that a would-be intruder can dislodge these fixing screws by applying a force to the partially opened door, i.e. attacking the door by means of kicking or shoulder charging the door. The present invention provides an improved locking device that is more resistant to attacks of this nature.

SUMMARY OF THE INVENTION

According to a first aspect of the invention there is provided a door guard assembly comprising:

a first part that is attachable to a door;

a second part that is attachable to a door frame;

an elongate member;

a slidable plate that comprises a receiving means;

wherein the first part and/or the second part and/or the elongate member further comprise(s) a dampening means; and, wherein the elongate member is attached to the first part or the second part and in use can be engaged with the receiving means of the plate located on the other first or second part respectively when the plate is slid into an operating position such that the receiving means engages the outer surface of the elongate member as the door is opened and the receiving means and elongate member thus limit the opening of the door, and the dampening means absorbs an impact force that may be applied to the door whose opening has been limited in this way.

The door guard assembly described herein provides an advantage in that it is more resistant to attack by a would-be intruder, as compared to previously known door guard assemblies, as the damper absorbs a force applied to the partially opened door, when the door security device (door guard assembly) claimed herein is in use. Additionally, the use of a slidable plate to activate the door guard assembly (such that the door guard assembly is in its second operative (or standby) position) is particularly advantageous as it provides for easier activation of the device as compared to other known door guard assemblies; where, for instance, with other door guard assemblies, it may be necessary to engage a door chain end stop on a first part of the assembly with an elongate slot on a second part—such engagement which may require considerable manual dexterity.

Preferably the dampening means comprises one or more resiliently deformable body/bodies.

Preferably the resiliently deformable body/bodies is/are chosen from the group comprising one or more spring(s) and/or one or more bodies comprised of a resiliently deformable material.

More preferably the spring(s) comprises a helical spring (s).

More preferably the helical spring(s) is/are in the form of a tension coil spring(s) or a compression spring(s).

Preferably the dampening means is located, in use, within a door frame.

More preferably the elongate member is chosen from the group comprising an elongate housing for a spring or an elongate tension coil spring.

More preferably the assembly further comprises a means to limit the amount by which the spring may be extended when the dampening means is a tension coil spring.

Preferably the elongate member, in use, is pivotally connected to the door frame and the slidable bolt is connected to the door by means of a fixing means. The fixing means is normally a metal plate that is attached to the door and engages with the slidable plate in use. The elongate member is normally pivotally attached to the door frame using an anchor bracket which together with other components described herein comprise a door frame anchor means.

Preferably, in use, the elongate body is pivotally mounted such that it rises in a generally vertical direction as the door is opened with the plate in its operative position, due to the engagement of the receiving means with the outer surface of the elongate member.

Preferably the receiving means comprises a first aperture located at one end of the plate, the first aperture being adjacent a second larger aperture, the larger aperture being sized to receive and engage the outer surface of the elongate member.

Preferably the elongate body comprises a stop that cannot pass through the second larger aperture.

The stop, in use, engages with the larger aperture in the plate to prevent the elongate body disengaging from the receiving means. When the receiving means comprises a first aperture adjacent a second aperture then it is the second aperture that engages the stop in use. In this way a large surface area of the plate is engaged with the stop, such that any impact force applied to the door that is not absorbed by the dampening means is transmitted to a large area of the plate thus reducing potential damage to the plate.

More preferably the spring is pivotally mounted to the door frame by means of a pivot bolt, the pivot bolt comprising a screw thread by which the tension coil spring is attached to the pivot bolt.

More preferably the resiliently deformable material is an elastomeric material.

According to a second aspect of the invention there is provided a door guard assembly for use with a door and its associated door frame.

According to a third aspect of the invention there is provided a kit of parts for forming a door guard assembly wherein the kit of parts comprises a first part that is attachable to a door; a second part that is attachable to a door frame; an elongate member; a slidable plate that comprises a receiving means; and wherein the first part and/or the second part and/or the elongate member further comprise(s) a dampening means.

Preferably the kit of parts further comprises a helical spring.

More preferably the kit of parts further comprises an elongate housing for a spring or an elongate tension coil spring.

According to a fourth aspect of the invention there is provided a door guard assembly comprising:

an anchoring means that is attachable to a door frame;

a damper assembly that is attachable to a door and that comprises a dampening means;

a connection means;

a dampening means comprising two or more resiliently deformable means;

wherein the connection means is attached to the anchoring means or the damper assembly and in use the connection means may be engaged with the other anchoring means or damper assembly respectively, such that when the door guard assembly is in its operating position the connections means limits the opening of the door and the dampening means absorbs an impact force that may be applied to the door whose opening has been limited in this way.

Preferably the deformable means further comprises two or more resiliently deformable springs.

DETAILED DESCRIPTION OF THE INVENTION

Specific embodiments of the invention will now be described, by way of example only, with reference to the accompanying drawings, in which:—

FIG. 12 illustrates a front elevation, including a partial cross-sectional view, of an alternative spring damper door frame assembly for use with the door guard plate illustrated in FIG. 1.

FIGS. 13 and 14 illustrate perspective views of a pivot bolt, a roll pin and a short threaded bolt for use with the spring damper illustrated in FIG. 12.

FIG. 15 illustrates a front elevation, including a partial cross-sectional view, of a further alternative spring damper door frame assembly for use with the door guard plate illustrated in FIG. 1.

FIG. 16 illustrates a front elevation, including a partial cross-sectional view, of another alternative spring damper door frame assembly for use with the door guard plate illustrated in FIG. 1.

FIG. 17 illustrates a perspective view of a protector plate for use with door guard assemblies of the type generally illustrated in FIGS. 1 to 16 and 19 to 21.

FIG. 18 illustrates a partial cross-sectional view of a fixing plate for use with door guard assemblies as disclosed herein with reference to FIGS. 1, 12, 15, 16, 19 and 20, wherein the spring damper of the device is not located within a door frame.

FIGS. 19 and 20 illustrate front elevations, including partial cross-sectional views, of further alternative spring damper door frame assemblies for use with the door guard plate illustrated in FIG. 1.

FIG. 21 illustrates a perspective view of a long bolt (elongate member or body) used in the spring damper illustrated in FIG. 19.

FIG. 22 illustrates a perspective view of an alternative door guard assembly wherein, in use, the spring damper is located within the door frame.

FIG. 23 illustrates a cross sectional view through the spring damper (and door frame) of the door guard assembly shown in FIG. 22.

FIG. 24 illustrates a cross sectional view through a further alternative embodiment of a door guard assembly similar to the assembly shown in FIG. 23.

FIG. 25 illustrates a number of components that are used in the assembly of the spring damper illustrated in FIG. 24.

FIG. 26 illustrates a partial cross-sectional view of a further embodiment of a door guard assembly wherein the spring damper is located within a housing attached to a door, in use, and wherein the assembly also comprises a key activated locking mechanism.

FIG. 27 illustrates a perspective view of a spring enclosure plate for use with the door guard assembly illustrated in FIG. 26.

FIG. 28 illustrates a front elevation of a further embodiment of a door guard assembly that utilises two springs in the spring damper door guard assembly.

FIG. 29 illustrates partial cross-sectional front elevation view of the door guard spring damper assembly shown in FIG. 28.

FIG. 30 illustrates further cross-sectional front elevation view through the spring damper door guard assembly shown in FIG. 28.

FIG. 31 illustrates a front elevation view of a further embodiment of a door guard assembly that utilises two springs in the spring damper door guard assembly and wherein the springs are engaged by means of a steel wire.

FIG. 32 illustrates a front elevation view of a fixing plate and various components mounted thereon.

FIG. 33 illustrates a door fixing plate suitable for use with the embodiments of the door guard assembly illustrated in FIGS. 31 and 32.

FIG. 42 illustrates a schematic cross-sectional side view of a dis-assembled locking mechanism of the type illustrated in FIGS. 26, 39 and 40.

FIG. 43 illustrates a cross-sectional side view of the assembled locking mechanism as illustrated in FIGS. 26, 39 and 40, the locking mechanism being located in its locked position.

FIG. 44 illustrates an end view of the body of the locking mechanism as previously illustrated in FIGS. 26, 39, 40, 42 and 43.

FIG. 45 illustrates diagrammatically the relative positions of a ball bearing, a cam follower and a cam when the locking mechanism shown in FIGS. 26, 39 and 40 is in its locked and unlocked positions.

FIG. 46 illustrates a cross-sectional view of an alternative version of a non-spring damper door frame anchor means.

FIG. 47 illustrates a cross-sectional view of a further example of a door frame spring damper anchor means further comprising a sleeve, and an alternative barrel lock to those previously illustrated.

FIG. 48 illustrates perspective view of the barrel of a lock for use with the locking mechanism illustrated in FIG. 47.

FIG. 49 illustrates diagrammatically the relative positions of a ball bearing, a cam and a cam follower when the locking mechanism shown in FIG. 47 is in its locked and unlocked positions.

FIG. 50 illustrates a perspective view of the metal sleeve illustrated in FIG. 47.

FIG. 51 illustrates a front view of the door frame spring damper anchor means illustrated in FIG. 47.

FIG. 52 illustrates a perspective view of a lockable door frame anchor means that does not comprise a spring damper means.

FIG. 55 illustrates a front view of a further alternative door guard assembly according to the present invention in its inoperative position.

FIG. 56 illustrates a cross sectional view of the components of a spring damper enclosure of the door guard assembly illustrated in FIG. 55.

FIG. 57 illustrates a front view of a further alternative door guard assembly according to the present invention wherein the door guard assembly is in its second operative (or standby) position and a door edge protection plate is also shown.

FIG. 58 illustrates a perspective view of the door guard plate used shown in FIG. 57.

FIG. 59 a perspective view of a further alternative door guard assembly according to the present invention.

Figure 60:
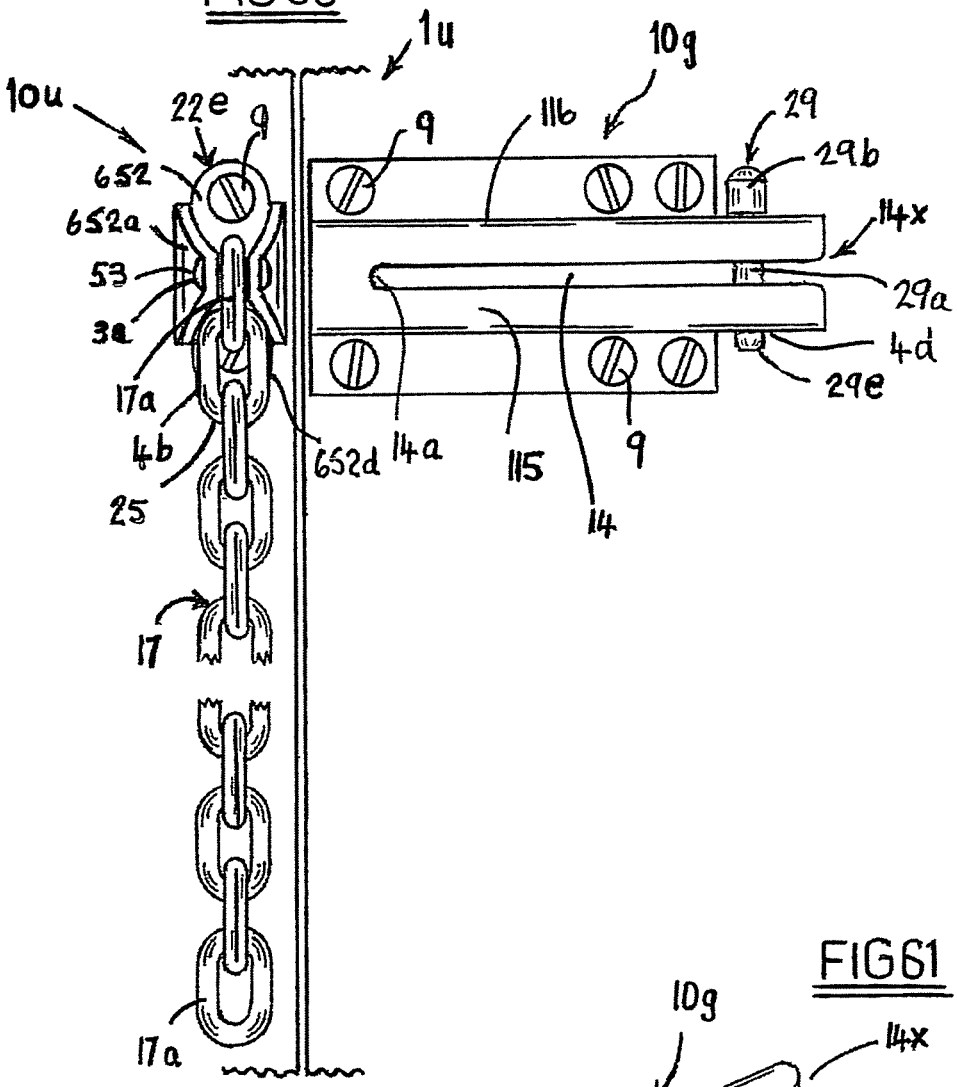

FIG. 60 illustrates a plan view of a non-damper door guard assembly.

Figure 61:
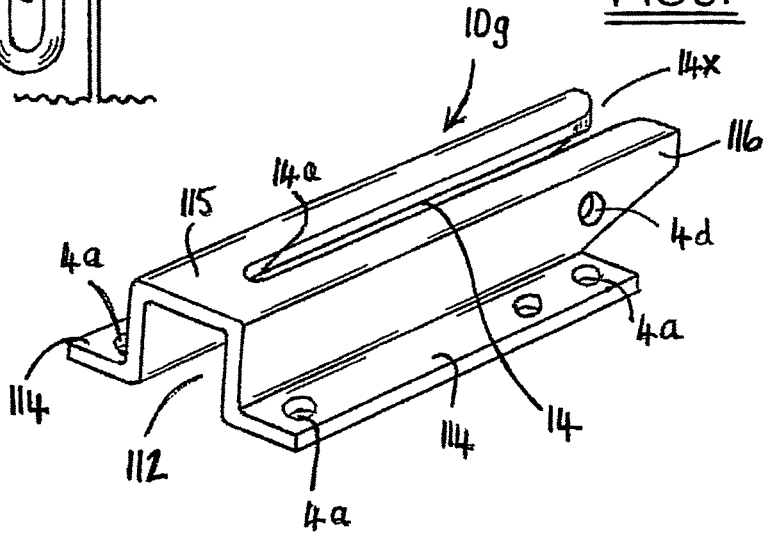

FIG. 61 illustrates a perspective view of the door guard plate shown in FIG. 60.

Figure 40:
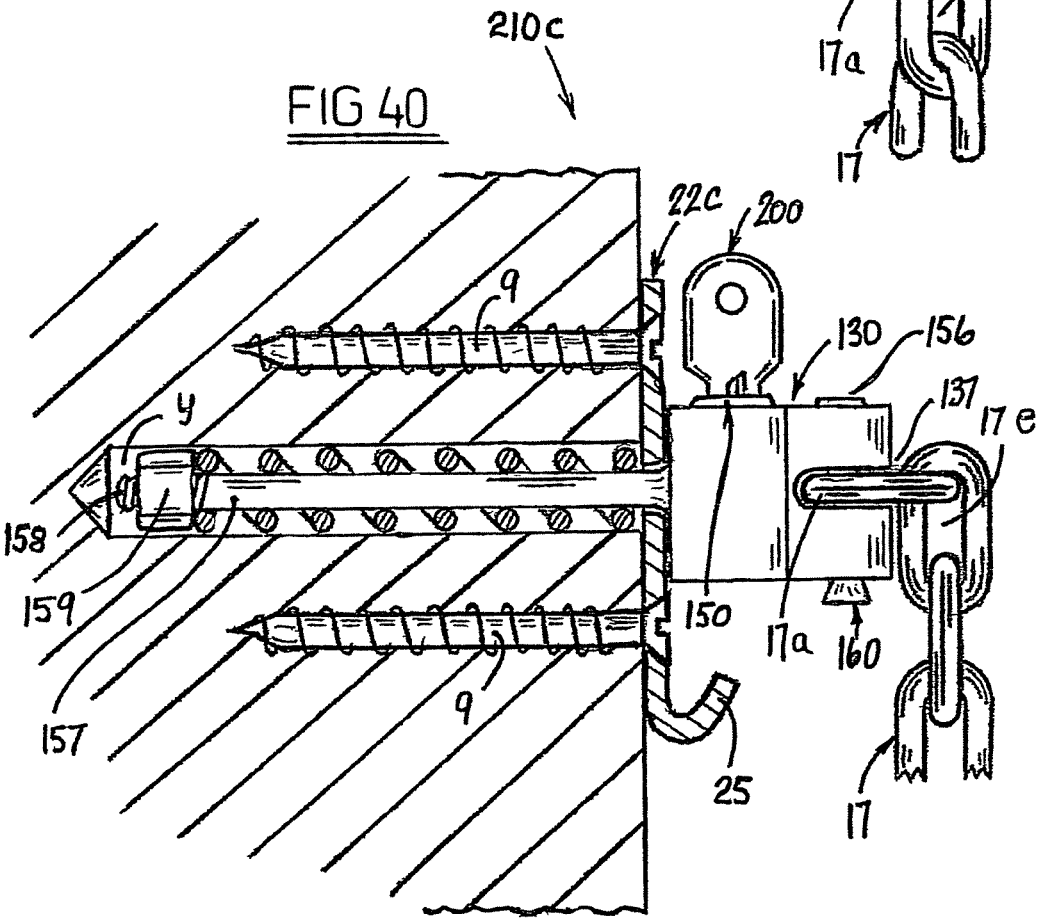
FIG. 40 illustrates a partial cross-sectional side-view of a door frame spring damper anchor means, in use, comprising a key lockable locking mechanism of the type illustrated in FIGS. 26 and 39.

FIG. 62 illustrates a front partial cross-sectional view of a further embodiment the door guard assembly shown in FIG. 60 that comprises a locking pin, and a lockable spring damper door frame fixing plate of the type previously illustrated in FIGS. 40 and 47.

FIG. 63 illustrates a partial cross-sectional view of the door guard plate shown in FIG. 62 along the line b-b.

FIG. 64 is a side view of the components of the door frame anchor means 10*u* of FIG. 60.

FIG. 65 is a front view of the door frame anchor means of FIG. 64.

FIG. 66 is a perspective view of the components of a non-damper door frame anchor means.

FIG. 67 is a perspective view of the preferred screws and bolts for fixedly attaching a door frame anchor means.

Where possible, the same, or similar numerals, have been used in this specification to denote similar components.

Figure 1:
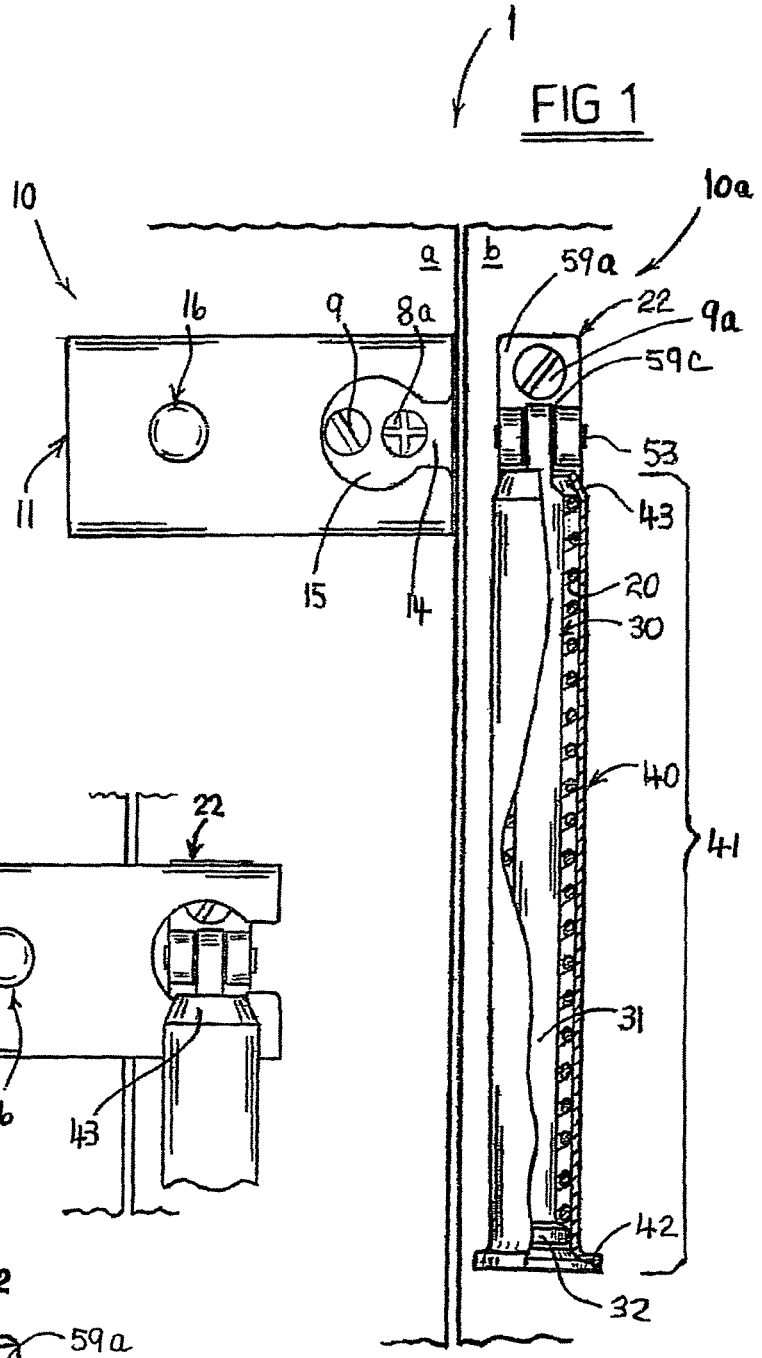
FIG. 1 illustrates a front elevation of a door guard assembly, in its first inoperative position, and includes a partial cross-sectional view, according to the present invention.

FIG. 1 of the drawings illustrates a complete door guard assembly (as generally indicated by 1), the assembly being fixedly secured to a door 'a' and door frame 'b'. The door guard assembly comprises a door guard plate generally indicated by 10 further comprising a fixing plate 2, as shown on FIG. 2, a slidable captive bolt (or slidable plate) 11 and a handle generally indicated by 16. The components of the door frame anchor means generally indicated by 10*a*, as shown on FIG. 1, comprise a door frame anchor bracket 22, a long (elongate) bolt generally indicated by 30, and a damper (compression) spring 20 located within a tubular steel spring housing (elongate member) 40.

FIGS. 4 to 7 are perspective views of the components that together form the door guard plate generally indicated by 10*b*.

Figures 4, 5, 6, 7, 8, 9:
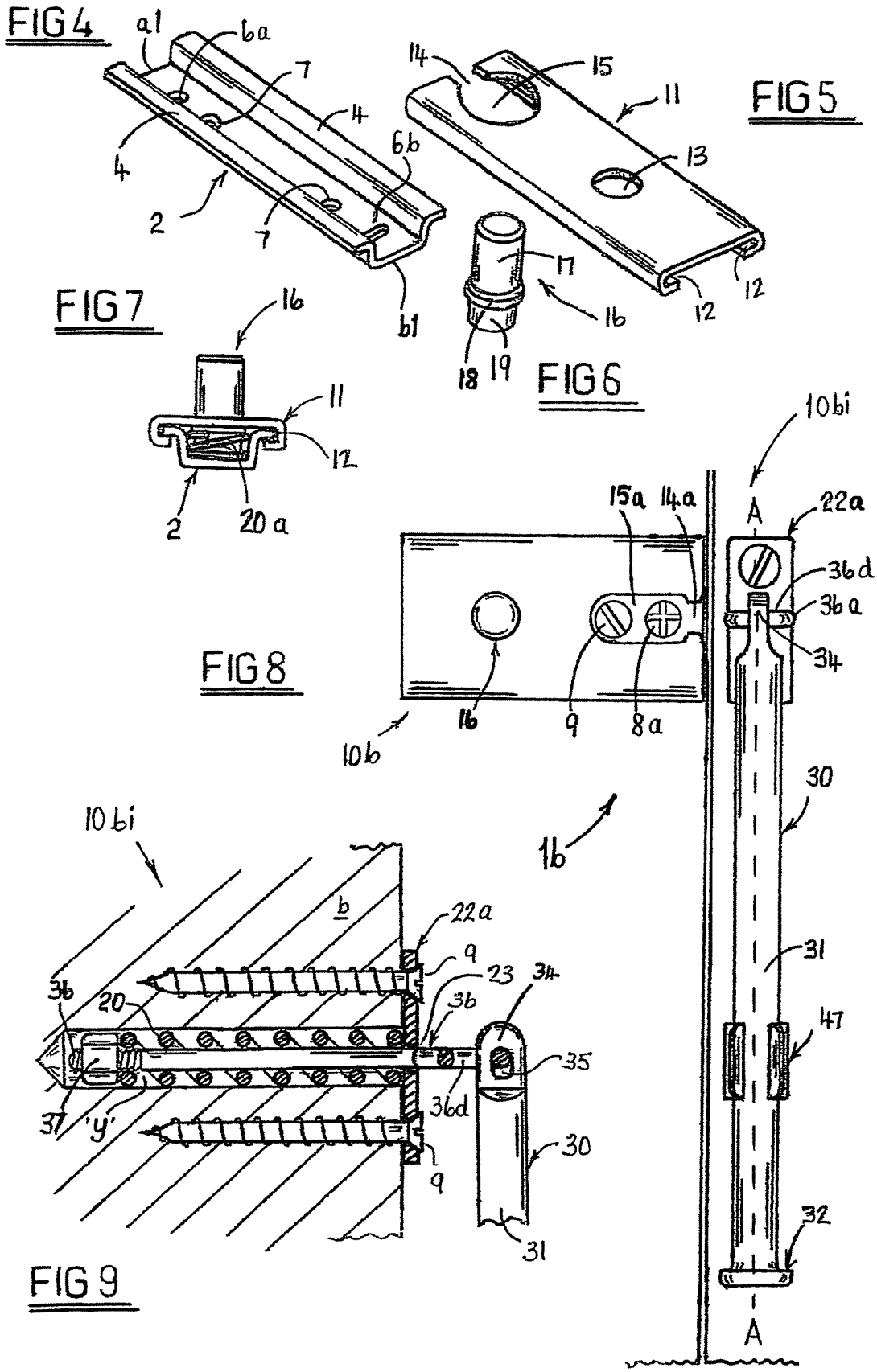
FIGS. 4 to 7 illustrate perspective views of the components that together comprise a door guard plate for a door guard assembly according to the present invention.
FIG. 8 illustrates a front elevation of an alternative embodiment of a door guard assembly, in its first inoperative position, according to the present invention.
FIG. 9 illustrates a partial cross-sectional view of a door frame anchor means, along the line A-A on FIG. 8.

As can be seen on FIG. 4 the door fixing plate 2 comprises a metal plate the edges of which have been folded to form a channel, wherein a small portion of the sides of said channel has been bent outwards to form flanges 4, said flanges 4 being located such that they engage with a pair of channels 12 incorporated in the captive bolt 11 (i.e. a slidable plate), as shown on FIG. 5. A pair of spaced apertures 6*a* and 6*b* are provided, centrally and longitudinally aligned in the base of the fixing plate 2, the aperture 6*b* is elongated and is close to the back b1 of the fixing plate 2 and the aperture 6*a* is close to the front al of said plate 2. The apertures 6*a* and 6*b* are sized to receive fixing screws 8*a* (shown on FIG. 1) and 8 (as shown on FIG. 2) that in use are used to secure the fixing plate 2 to a door 'a'. The heads of the screws 8*a* and 8 are located and sized such that they abut the spring located on the handle 16 when it is supported on the captive bolt 11 and limit the transverse movement of the captive bolt 11, on the fixing plate 2, to distance between the fixing screws 8*a* and 8 and hence render the captive bolt 11 captive on the fixing plate 2, i.e. prevent the captive bolt 11 from slidably disengaging from the fixing plate 2. The rear screw fixing aperture 6*a* is preferably a slot (that is vertically orientated in use) and thus provides for vertical adjustment of the plate when fitting the fixing plate 2 to a door 'a'. Additional countersunk screw fixing apertures 7 are also provided on the fixing plate 2, as shown on FIG. 4.

The captive bolt 11 comprises an elongate metal plate, the side edges of the plate having been folded to form narrow channels 12 at each side of said bolt 11, said channels 12 being located such that they can engage with flanges 4 of the fixing plate 2, thereby allowing the captive bolt 11 to be slidably mounted on the fixing plate 2, for transverse movement thereon, between its two positions. The narrow channels 12 also act to strengthen the captive bolt 11. An aperture 13 is provided in the captive bolt 11, the aperture being centrally and longitudinally aligned with the screw fixing apertures 6*a* and 6*b* in the guard plate 2, said aperture 13 being sized to receive a handle (as generally indicated by 16 on FIG. 6) by means of which the captive bolt 11 may be moved between its two positions on the guard plate 2. A narrow slot (first aperture) 14 is provided centrally in the front end (the end of the plate closest to the vertical edge of the door in use) of the captive bolt 11 said slot 14 leading to a larger slot (second aperture) 15 which is large enough in diameter to receive the main body (elongate member) 41 of the spring housing 40, but the larger slot being too small in diameter to allow the fluted end 42 of the housing 40 to pass through.

The handle 16 (as clearly shown in FIGS. 6 and 7) may be a turned metal component comprising a main body 17 and further comprising a raised annular boss 18 part way along its length, the main body 17 of the handle 16 will pass through the aperture 13 in the captive bolt 11 which provides that when the handle 16 is loaded into the aperture 13 in the captive bolt 11 from the inside thereof the raised annular boss 18 prevents said handle 16 passing through the captive bolt 11, as shown on FIG. 7. A compression spring 20*a* is mounted on a body portion 19 of the handle 16 and provides that when said captive bolt 11, handle 16 and spring 20*a*, as a sub-assembly, are mounted on the fixing plate 2 the spring 20*a* acts to bias the captive bolt 11 outwards and against the guard plate 2, said spring 20*a* providing considerable resistance to relative transverse movement of the captive bolt 11 on the guard plate 2. The captive bolt 11 may be moved between its first inoperative position and second operative (or standby) position on the guard plate 2 against the force of the compression spring 20*a*, said spring holding the captive bolt 11 firmly in either of said two positions on the guard plate 2. It is the spring 20*a* mounted on the handle 16 that actually abuts the large heads of the fixing screws 8*a* and 8.

The door frame anchor means 10*a*, as shown in FIG. 1, comprises an anchor bracket generally indicated by 22, a strong damper compression spring 20, a bolt 30 having a large head 32 (stop means) at one end (the end of the bolt that in use is located distal to the anchor bracket) to retain the damper spring 20 thereon and an eyehole 35 at its other end (as shown on FIGS. 10 and 21), a metal tube 40 which acts as a guidable enclosure and housing for the damper spring 20. The top end (in use) of the tubular enclosure 40 is narrower than the rest of the housing, as shown at 43, in this way the spring is trapped within the tubular housing, and this allows said tubular housing 40 to be supported on one end of the spring 20. The other end of the tubular housing 40 incorporates fluting as shown at 42, said fluted end 42 is of a diameter such that it will not pass through the annular slot end portion 15 of the captive bolt 11. The body of the housing 40 is sized such that it cannot pass through the slot 14 in the captive bolt 11.

The term "strong" is used to indicate a spring that is capable of absorbing an impact that is applied to a door by an intruder, the door being fitted with a door guard assembly in its operative position as herein disclosed, when the intruder is attempting to force entry past the door.

In order to sub-assemble the damper spring enclosure, the spring 20 is first located on the bolt 30 and is retained on the bolt 30 by the head of the bolt 32. The combined bolt 30 and spring 20 assembly is then inserted into the tubular housing 40 through the opening in its fluted end 42, such that the shoulder 34 (see FIGS. 8 and 9) at the end of the bolt 30 (which incorporates an aperture 35) protrudes or extends outward from the 'rolled' end 43 of the tubular housing 40; at this point the inner surface of the narrow end 43 of the tubular housing 40 is supported/engaged by the end of the spring 20. The tubular spring housing 40 is now resiliently supported on the bolt 30 by means of the spring 20 and any pulling forces applied to the fluted end 42 of the tubular housing 40 will be absorbed by the spring 20. The bolt 30, spring 20 and tubular housing assembly may now be pivotally mounted on the metal door frame anchor bracket 22 by means of the pivot pin 53, the pivot pin 53 is preferably a roll pin.

Figure 3:
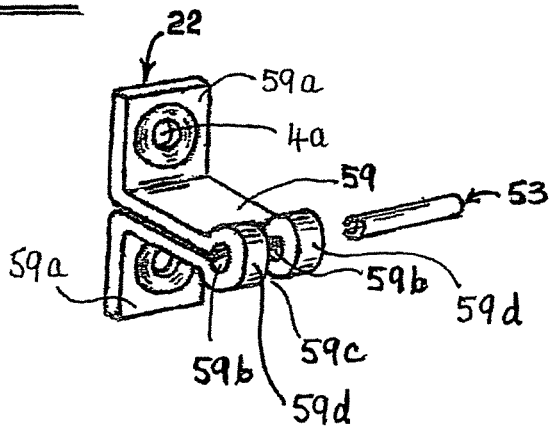
FIG. 3 illustrates a perspective view of a door frame anchor bracket for a door guard assembly according to the present invention as previously illustrated in FIG. 1.

FIG. 3 is a perspective view of the door frame anchor bracket generally indicated by 22 and a roll pin 53.

The door frame anchor bracket 22 (as illustrated in FIG. 3) is generally T shaped, comprising a main body 59 from which opposing limbs 59*a* extend outwardly from one end of said main body 59, a screw or bolt fixing aperture 4*a* is defined (provided) centrally in each of the limbs 59*a* respectively to facilitate the securing of the anchor bracket 22 to a door frame 'b'. A horizontal through aperture 59*b* is provided adjacent the other end of the body 59 (i.e. the end of the body 59 that is distal from the limbs 59*a*) to receive a pivot pin 53, the through aperture 59*b*; being formed by the folding of the sheet metal used to manufacture the door frame anchor bracket 22. A vertical slot 59*c* is provided centrally in the distal end of the body 59, said slot 59*c* extending inwards of the distal end of the main body 59 to intersect and pass through a portion of the main body such that the through aperture 59*b* is formed by two arms (59*d*) as shown on FIG. 3. The slot 59*c* provides an opening in the main body 59 of the anchor bracket 22 into which the reduced shoulder 34 (of the end of bolt 30) may be located, such that the aperture 35 in the end of the bolt 30 may be aligned with the apertures 59*b* in the bracket 22 and thus the pivot pin 53 may be inserted through said apertures 59*b* (in the two arms 59*d*) and the aperture 35 respectively to pivotally secure the damper spring enclosure assembly to the door frame anchor bracket 22. The door frame anchor means is now fully assembled and ready to be secured to a door frame 'b'.

Preferably the door frame anchor bracket 22 is secured to the door frame 'b' by means of coarse threaded anchor screws (60 (not shown on FIG. 3, but as illustrated in FIGS. 64 to 67)), and associated threaded metal bolts 9*a* of the type illustrated in FIGS. 64 to 67 67. Alternatively, conventional metal wood screws or cross dowel nuts D may be used.

In order to fixedly secure the door guard plate 10 to a door 'a', the captive bolt 11 with handle 13 and compression spring 20*a* engaged thereon is loaded onto the fixing plate 2 (see FIG. 7). This door guard plate assembly 10 is placed in the desired location against the door surface and the large headed screw 8*a* is entered through the aperture 6*a* in the fixing plate 2 (via the aperture that is located adjacent the end aperture 15) and screwed fully into the door 'a'. The fixing plate 2 is now attached to the door 'a' such that the captive bolt 11 may be moved transversely on the fixing plate 2 until the spring 20*a* on the handle 16 abuts the large head of the screw 8*a* at which point the elongated aperture 6*b* becomes accessible and the screw 8 can be entered into the aperture 6*b* and screwed fully into the door 'a'. Should the door guard 10 not be aligned correctly with the door frame anchor means 10*a*, the slot 6*b* allows for fine adjustment of the fixing plate 2. Additional countersunk screws 9 may then used to further secure the fixing plate 2 by means of the countersunk apertures 7. The complete door guard assembly 1 of FIGS. 1 to 7 is now fixedly secured to a door 'a' and door frame 'b' (see FIG. 1).

Figure 2:
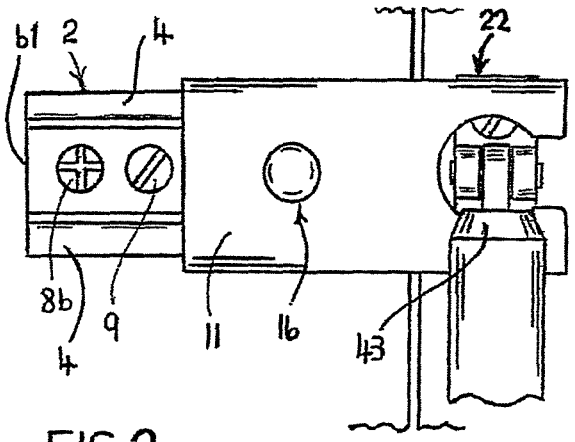
FIG. 2 illustrates a partial front elevation of the door guard assembly as illustrated in FIG. 1 wherein the assembly is in its second operative (or standby) position.

In use, with the door 'a' closed and against the door frame 'b' the door guard assembly is in its first inoperative position, the spring damper enclosure is suspended vertically from the door frame anchor means 10*a* and the captive bolt 11 is spring biased against transverse movement on the guard plate 2 by the compression spring 20*a*, in which position the components of the door guard assembly assume the position illustrated in FIG. 1. In order to place the door guard assembly in its second operative (or standby condition) the handle 16 is used to slide the captive bolt 11 transversely on the guard plate 2, against the force of the spring 20*a*, until said spring 20*a* mounted on the handle 16 abuts the large head of the screw 8*a*, at this point the captive bolt 11 is located behind the spring damper enclosure (housing 40) and the components of the door guard assembly 1 assume their standby condition, as illustrated in FIG. 2.

Figure 11:
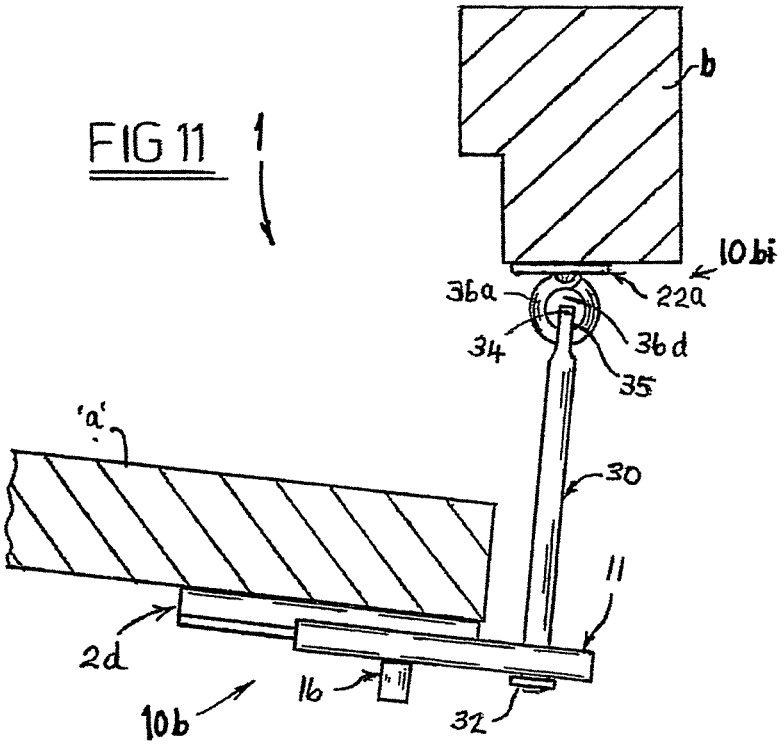
FIG. 11 illustrates a partial cross-sectional plan view of the door guard assembly shown in FIGS. 8 and 9, in use, with the door opened to its maximum distance with the door guard assembly in its third operative position.

When a caller comes to the door, as the door 'a' is opened for 'inspection' the captive bolt 11 abuts (engages) the outer surface of the spring damper enclosure (housing 40) such that the spring damper enclosure (housing 40) is raised from a vertical to a horizontal position as the tubular body of the housing 40 is drawn through the wider slot end portion 15 of the captive bolt 11, until the opening of the door 'a' is arrested when the large fluted end 42 of the spring housing 40 abuts the captive bolt 11; further opening of the door 'a' is arrested in this way the components of the door guard assembly are in their third operational condition (as illustrated in FIG. 11).

The door guard assembly is now operational and the caller may now be 'inspected' (through the restricted/partial opening of the door provided by the door guard assembly, as described above, in operation and after inspection the door 'a' must be returned to its fully closed position to allow the captive bolt 11 to be disengaged from the spring damper enclosure (housing 40), i.e. to disengage the door guard assembly the captive bolt 11 is moved transversely on the fixing plate 2 from the standby (second operative) position back to its first inoperative position, as shown in FIG. 1.

The above door frame damper anchor means is arranged, in use (i.e. when in its third operative position), to absorb and cancel out pressure or impacts that are applied to the door 'a' by a would-be intruder, thereby protecting the anchor points on said door 'a' and door frame 'b' and also preventing possible damage to the door 'a' and the associated door frame 'b'.

FIG. 8 is a front view of a complete door guard assembly (as generally indicated by 1*b*) in its first inoperative condition, fixedly secured to a door 'a' and door frame 'b'. In this example the door guard plate 10*bi* is similar to that of the previous embodiment as shown in FIGS. 1 to 6, but the slot 14*a* and the larger slot 15*a* are smaller than the corresponding slots in the previous embodiment, additionally a number of alternative components have been utilised in the door frame anchor means as detailed below.

The components of the door frame anchor means 10*bi* comprise a metal fixing plate 22*a*, a long (elongate) bolt 30 and a threaded eyebolt 36 with locknut 37.

The spring damper element of this embodiment is recessed into the door frame 'b' (see FIG. 9), the fixing plate 22*a* incorporates a slot 23 that is centrally located on the fixing plate 22*a*, said slot 23 being sized to receive an eyebolt 36. A pair of screw or bolt receiving apertures 4*a* are also provided in the fixing plate 22*a* one at each end thereof. The head 36*a* of the eyebolt (adjacent to where it joins the body 36), in use, partially engages the slot 23 in the fixing plate 22*a* to prevent rotation of the eyebolt. The fixing plate 22*a* will arrest any sideways forces that may be applied to the door frame anchor means (10*bi*) with which this spring damper element is used.

To sub-assemble this door frame anchor means 10*bi*, the bolt (elongate member) 30 is first engaged in the eye 36*d* of the eyebolt 36—the eyebolt used may be an open eye bolt that is welded closed once the bolt 30 and the eye 36*d* have been engaged, in this way the bolt 30 is pivotally suspended (see FIG. 9) from the eyebolt in use. The fixing plate 22*a* is then loaded onto the eyebolt 36 followed by the compression spring 20, the locknut 37 is then screwed onto the end of said eyebolt 36 such that it abuts the spring 20 and places a slight load onto said spring 20, which in turn results in the head 36*a* of the eyebolt 36 being engaged against the front face of the fixing plate 22*a*. The door frame anchor means 10*bi* is now assembled and ready to be fixedly secured to a door frame 'b' and is preferably secured by means of a pair of coarse threaded anchor screws 60 and associated threaded metal bolts 9*a* (as shown in FIG. 67). Alternatively a pair of cross dowel nuts (that are located in appropriate recesses in the door frame) and associated threaded metal bolts may be used Conventional metal wood screws 9, as shown in FIG. 9, may also be used. In either case, suitable shaped and sized openings must be provided in the door jamb.

The head 32 of the long bolt 30 will not pass through the wider slot end portion (the larger slot) 15*a* in the captive bolt 11 and the body 31 of said bolt 30 will not pass through the entry slot 14*a* in the captive bolt 11.

A spring clip 47 may be secured to the door frame 'b' in which the body 31 of the bolt 30 may be stowed when the door guard assembly 1 is not in use.

FIG. 9 is a part cross sectional view of the door frame anchor means 10*bi* as illustrated in FIG. 8, taken along the line A-A, fixedly secured to a door frame 'b' with conventional wood screws 9, clearly showing the bolt 30 pivotally engaged within the eye 36*d* of the eyebolt 36 by means of the aperture 35 of the bolt 30.

In use, with the door 'a' closed and against the door frame 'b' the door guard assembly is in its first inoperative position, the bolt 30 is suspended vertically from the eyebolt 36, the body 31 of said bolt 30 is engaged in the spring clip 47, the captive bolt 11 is spring biased against transverse movement on the guard plate 22*a* by the compression spring 20*a*, as shown in FIG. 8. In order to place the door guard assembly in its second operative or standby condition, the handle 16 is used to slide the captive bolt 11 transversely on the guard plate 2, against the force of the spring 20*a*, until said spring 20*a* which is engaged on the handle 16 abuts the large head of the screw 8*a*, when the captive bolt 11 will be located behind the body 31 of the bolt 30, as was illustrated for the previous embodiment in FIG. 2.

When a caller comes to the door 'a' and as the door is opened for 'inspection' the captive bolt 11 abuts the body 31 of the bolt 30 and said bolt 30 is forced out of the clip 47 as the bolt 30 is simultaneously drawn through the wider slot end portion 15*a* of the captive bolt 11, until opening of the door 'a' is arrested when the large head 32 of the bolt 30 abuts the captive bolt 11 at which point further opening of the door 'a' is prevented, FIG. 11 shows the door opened to its maximum distance with the door guard assembly in use.

The door guard assembly is in its third operational position (i.e. is fully operational) and the caller may now be 'inspected'. The door frame damper anchor means, when the door is positioned in this third operational position as illustrated in FIG. 11, will absorb and cancel out all pressure or impact applied to the door 'a' by a would-be intruder (the force of the pressure or impact being absorbed by the compression spring 20), thereby protecting the anchor points on said door 'a' and door frame 'b' and preventing possible damage to said door and frame.

After inspection the door 'a' must be closed fully to allow the captive bolt 11 to be disengaged from the bolt 30. The captive bolt 11 is then moved transversely on the fixing plate 2 back to its first inoperative position, as shown in FIG. 8.

In an alternative arrangement, the door frame anchor bracket 22 of the previous embodiment may be used to replace the fixing plate 22*a* and the bolt 30 secured in and pivotally suspended from the anchor bracket 22 by means of the pivot pin 53. This will provide a rigid, surface mounted, non-damper door guard assembly 1.

Figure 10:
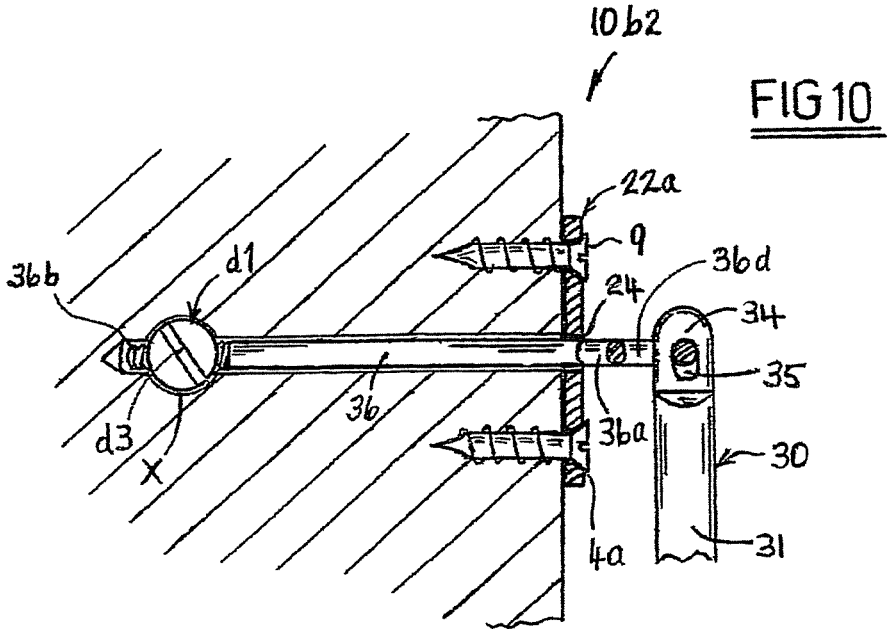
FIG. 10 illustrates a cross-sectional view of a further alternative embodiment of door frame anchor means, the view provided corresponding to the cross-sectional view of FIG. 9.

FIG. 10, illustrates an example of a rigid non-damper door frame anchor 10*b*2 in which the eyebolt 36 is swivelably engaged with, and supporting, the long bolt 30. The eyebolt has been screwed into a cross dowel nut d1 embedded in the door frame 'b'. A slot d3 also is provided as shown. Details of the installation using a cross dowel nut d1 and associated threaded bolt 9*a* are provided below with reference to FIGS. 22 and 23.

FIG. 11, shows the position of the door guard components after a caller has knocked on the door and the door 'a' has been (partially) opened for inspection, opening of the door 'a' has been arrested when the head 32 of the bolt 30 abuts the captive bolt 11. In respect of the first embodiment described above, as shown in FIG. 1, the opening of the door 'a' would be arrested when the fluted end 42 of the tubular housing (elongate member) 40 abuts the captive bolt 11—the door guard is in its third operational position (i.e. is fully operational). The caller may now be 'inspected' and after inspection the door 'a' must be closed fully to allow the captive bolt 11 to be disengaged from the bolt 30 and the captive bolt 11 moved transversely on the guard plate 2 by means of the handle 16 from its operational to its inoperative position, (see FIGS. 1 and 8).

FIG. 12 illustrates a spring damper door frame anchor means (door frame anchor) 10*a* that may be used in conjunction with the door guard plate 10 of FIG. 1. In this example, the compression spring 20 is visible (i.e. the spring is the elongate member and is not enclosed in a tubular housing 40) and the door guard plate 10 that is shown is identical to that in FIG. 1.

The door frame anchor means 10*a* of this example, as shown on FIG. 12, comprises a metal fixing plate 22*a*, a threaded shouldered bolt (generally indicated by 58), a pivot pin 53, a threaded pivot bolt 50 (as generally indicated on FIG. 13), a helical spring 20 (see FIG. 12) and a threaded bolt (as generally indicated by 55), and two coarse threaded anchor screws (not shown on FIG. 12, but illustrated later in relation to FIG. 66 as 60) that are used to attach the door frame anchor means to the door by means of two bolts (9*a*) one of which is visible, see later reference to FIG. 64, the anchor screws 60 are not visible on FIG. 12.

The metal fixing plate 22*a* defines an aperture 24 (as shown on FIG. 18) that is located centrally on the plate to receive the body of a threaded shouldered bolt 58, a pair of screw or bolt receiving apertures 4*a* are also provided in the fixing plate 22*a*, one at each end thereof. The coarse threaded anchor screw 60 defines an internal thread 63 to receive the external thread 58*e* of the shouldered bolt 58, screwdriver slots 65 are also defined (provided) in the anchor screw 60.

The pivot bolt 50 incorporates an external thread 54 at one end (as shown on FIG. 13), the diameter and pitch of said thread 54 allows it to be screwed tightly into one end of the helical spring 20. An aperture 50*b* is provided in the large tapered head 50*a* of the pivot bolt 50, adjacent the unthreaded end of the bolt (the top), said aperture 50*b* being provided to receive a pivot pin 53. A deep slot 50*c* is also defined (provided) in the top of the bolt head 50*a* said deep slot 50*c* extending inwards of the end of the bolt head 50*a* to intersect and pass the aperture 50*b*, said deep slot 50*c* providing a location for the reduced shoulder 58*c* at the end of the shouldered bolt 58. This allow the aperture 58*b* in the end of the shouldered bolt 58 to be aligned with the apertures 50*b* in the pivot bolt 50 such that a pivot pin 53 may be inserted through said apertures 58*b* and 50*b* respectively to pivotally secure the pivot bolt 50 to the shouldered bolt 58.

The short threaded bolt 55 comprises a shallow head 56 and a threaded portion thread 57, as shown on FIG. 14. The diameter and pitch of said thread 57 allows it to be screwed tightly into the other end of the helical spring 20. The head 56 of the bolt 55 has a larger diameter than the external diameter of the spring 20 and will not pass through the slot end aperture 15 in the guard plate 11 whilst the main body of the spring 20 will pass through said slot end aperture 15.

The threaded, shouldered bolt 58, see FIG. 18, comprises body 58*a* defining a small flat portion 58*c* adjacent one end of the bolt 58, an aperture 58*b* is provided in the flat portion 58*c* to receive a pivot pin 53 (see FIG. 12). A raised shoulder or boss 58*d* is provided at a position two thirds the length of the bolt 58 from the front thereof (i.e. from the end of the bolt incorporating the flat portion 58*c*), the other end of the bolt 58 defines a screw thread which extends outward from the boss 58*d*.

To assemble the door frame anchor means 10*a* as illustrated in FIG. 12, first enter the bolt 58 through the aperture 24 (as shown on FIG. 18) in the fixing plate 22*a* until the shoulder 58*d* on the bolt 58 abuts the back surface of the fixing plate 22*a*, then enter the flat portion 58*c* of the bolt 58 into the slot 50*c* in the pivot bolt 50 to align the apertures 58*b* and 50 *b* respectively in the pivot bolt 50 and shouldered bolt 58 and insert the pivot pin 53 through said aligned apertures. The helical spring 20 is then screwed tightly onto the pivot bolt 50 and the short threaded bolt 55 is screwed tightly into the free end of the helical spring 20. The door frame anchor means is now assembled, as shown in FIG. 12.

To attach the door frame anchor means 10*a* to a door frame 'b', first drill a pilot hole in the desired position in the door frame deep enough to allow the coarse threaded anchor screw to be recessed to a depth sufficient to accommodate the shoulder 58*d* on the anchor bolt 58. Now screw the coarse threaded anchor screw 60 into the pilot hole with a large screwdriver, an electric screwdriver or by means of the drive bolt 'z' (as shown in FIG. 67) and a flat spanner. The shouldered bolt 58 can now be screwed fully into the coarse threaded anchor screw (60), the shoulder 58*d* on the bolt 58 should be flush with the face of the door frame 'b' when the bolt is installed correctly. Fixing screws 9 are then entered into the apertures 4*a* in the fixing plate 22*a*, said screws 9 respectively are screwed fully into the door frame 'b' to provide additional rigid attachment of the anchor means 10*a* to said door frame 'b'.

FIG. 15 illustrates a door frame anchor means (as generally indicated by 10*a*) comprising a helical spring damper assembly with means to govern the amount the spring 20

(elongate member) is allowed to stretch or extend and thus thereby protecting the integrity of the spring 20. It will be noted that the spring 20 is not enclosed within a housing. The door frame anchor means 10*a* of this embodiment comprises a metal fixing plate 22*a*, a threaded shouldered bolt 58, a pivot pin 53, a threaded pivot bolt 51, a helical spring 20 and a long bolt 30.

The long bolt 30 has a body 31 slightly smaller in diameter than the inside diameter of the spring 20, the head 32 of said bolt 30 having a diameter similar to the outside diameter 20*b* of the main body of the spring 20, the front end of the bolt 30 is cone shaped 33*a* to allow it to nest within the conical end 20*c* of the spring 20. A threaded bore 35*a* is incorporated in the front end of the bolt 30 into which is screwed a correspondingly threaded portion of the pivot bolt 51. The helical spring 20 incorporates conical coiling 20*c* at one end reducing the diameter of the spring 20 and thereby allowing said spring 20 to be supported and captive on the conical end of the bolt 30, the spring 20 is fluted (increases in diameter as indicated at 21) to a larger diameter 20*a*, this larger diameter 20*a* may amount to one third the length of the spring 20, from the free end of said spring 20. This allows the bolt 30 to be hidden. In use, when pulling forces are applied to the fluted portion 21 of the spring 20 said spring can only be stretched until the head 32 of the bolt 30 abuts the inside diameter 21*a* of the spring 20, thereby limiting the amount the spring 20 is allowed to be stretched, and thereby protecting the integrity of the helical spring 20. The outside diameter 20*a* of the spring 20 is greater than the diameter of the slot end portion 15 in the captive bolt 11, of the door guard 10, said large diameter 20*a* of the spring 20 acts as an abutment stop for the captive bolt 11. The outside diameter 20*b* of the main body of the spring 20 is slightly smaller than the diameter of said slot end portion 15 allowing said main body 20*b* of the spring 20 to move freely in the aperture 15, however, said outside diameter 20*b* of the main body of the spring 20 cannot pass through the entry slot 14 in the captive bolt.

To assemble the door frame anchor means 10, as shown in FIG. 15, first enter the bolt 58 through the aperture 24 in the fixing plate 22*a* until the shoulder 58*d* on the bolt 58 abuts the back surface of the fixing plate 22*a*, then enter the flat portion 58*c* of the bolt 58 into the slot 50*c* in the pivot bolt 51 to align the apertures 58*b* and 50 *b* respectively of the pivot bolt 50 and shouldered bolt 58 and insert the pivot pin 53 through said aligned apertures. The helical spring 20 is then loaded onto the long bolt 30 when the conical end 33*a* of the bolt 30 will abut and nest within the conical end 20*c* of the spring 20. The pivot bolt 51 is then screwed fully into the conical end of the long bolt 30. The door frame anchor means 10 is now assembled.

To attach the door frame anchor means 10*a* to a door frame 'b', first drill a pilot hole 'y' in the desired position in the door frame 'b', deep enough to allow the coarse threaded anchor screw to be countersunk sufficient to accommodate the shoulder 58*d* on the anchor bolt 58. Now screw the coarse threaded anchor screw 60 into the pilot hole 'y' with a large screwdriver, an electric screwdriver or by means of the drive bolt b1 and flat spanner. The shouldered bolt 58 can now be screwed fully into the coarse threaded anchor screw 60, the shoulder 58*d* on the bolt 58 will be flush with the face of the door frame 'b'. Fixing screws 9 are then entered into the apertures 4*a* in the fixing plate 22*a*, said screws 9 respectively are screwed fully into the door frame 'b' to provide additional rigid attachment of the anchor means 10*a* to said door frame 'b'.

FIG. 16 shows a spring damper door frame anchor means 10*a*, which is very similar to the previous example of FIG. 15. The door frame anchor means 10*a* of this example comprises a metal fixing plate 22*a*, a threaded shouldered bolt 58, a pivot pin 53, a threaded pivot bolt 51, a helical spring 20 and a large threaded nut 57.

The long bolt 30 has a body 31 slightly less in diameter than the inside diameter of the spring 20, the head 32 of said bolt 30 has a diameter which is larger than the outside diameter of the spring 20, a threaded nut as generally indicated by 57 defines an internal thread 57*b* which has a diameter and pitch that corresponds to the outside diameter and pitch of the coils of the spring 20, which allows the nut 57 to be screwed tightly onto the free end 20*e* of the helical spring 20. The outside diameter 20*b* of the main body of the spring 20 is slightly smaller than the diameter of said slot end portion 15 in the captive bolt 11, this clearance allows said main body 20*b* of the spring 20 to move freely in the aperture 15, however, said outside diameter 20*b* of the spring 20 cannot pass through the entry slot 14 in the captive bolt. The threaded nut 57 secured to the free end 20*e* of the spring 20 will not pass through the slot end portion 15 of the captive bolt 11, said large threaded nut 57 acting as a resilient abutment stop against said captive bolt 11. When pulling forces are applied to the nut 57 the spring 20 can only be stretched until the end 57*c* of the nut 57 abuts the large head 32 of the bolt 30, limiting the amount the helical spring 20 is allowed to be stretched and thereby protecting the integrity of the helical spring 20.

Tolerances defined between the outside diameter of the bolt 30 and the inside diameter of the spring 20 can be arranged to determine the amount the spring 20 is allowed to stretch, the inside diameter of the spring 20 reduces progressively the more it is stretched. As the spring 20 is stretched it will automatically tighten and grab the body 31 of the bolt 30 and thus prevent further stretching of the spring 20, in which case the head 32 of the bolt 30 may not be required.

FIG. 17 is a perspective view of a door frame protector plate 3 comprising a flat plastic or metal disc comprising a body 3*a* and defining a central screw fixing aperture 3*d* by means of which the plate 3 is attached to a door frame 'b', as shown on FIG. 15. The protector plate 3 can be located on the door frame such as to prevent a pivotally mounted damper spring element or spring enclosure (housing) 40 from making contact with the door frame 'b'.

FIG. 18 is a part cross sectional side view showing the fixing plate 22*a*, shouldered threaded bolt 58, coarse threaded anchor bolt 60 and wood screws 9, as utilised in respect of the embodiments of the invention described above in reference to FIGS. 12, 15 and 16.

FIGS. 19 to 21 show further examples of alternative embodiments of the spring damper door frame anchor means as generally indicted by 10*a*. FIGS. 19 and 20 utilise the door frame anchor bracket 22 described and illustrated in the first embodiment as previously described with reference to FIGS. 1 to 3. In the arrangement shown in FIG. 19, the long bolt 30 (that can be more clearly shown on FIG. 21 wherein the spring has been omitted) incorporates a head 32 at one end, the other end of the bolt 30 defines a cone shape portion 33*a* from which a narrow, short projection 34 extends, said small projection 34 defines two opposing flat sides 34*a* and 34*b* respectively. The end of the projection 34 defines a full radius (i.e. the end of the bolt 34 is semi-circular in shape). An aperture 35 is provided centrally through said flat sides 34*a* and 34*b* of the projection 34, said aperture 35 (as shown on FIG. 21) is adapted to receive a pivot pin 53 (as shown on FIG. 19). The helical springs 20 shown on FIGS. 19 and 20, comprise conical coils 20*c* at one end and at the other end of the spring 20 fluted coils 21 are provided.

To assemble the door frame anchor means 10*a* of FIG. 19, first load the helical spring 20 onto the long bolt 30 when the conical portion 33*a* of the bolt 30 will abut and nest within the conical end 20*c* of the spring 20 and the narrow short projection 34 will be projecting outward of the conical end 20*c* of said spring 20, far enough to facilitate engagement in the door frame anchor bracket 22. The narrow short projection 34 of the bolt 30 is then entered into the slot 59*c* in the door frame anchor bracket 22 to align the apertures 35 and 59*b* respectively in the bolt 30 and anchor bracket 22, the pivot pin 53 is then inserted through said aligned apertures 35 and 59*b*. The helical spring 20 and bolt 30 assembly is now pivotally suspended from the anchor bracket 22 and the door frame anchor means assembly is complete.

The spring damper shown in FIG. 19 is provided with a means to govern the amount that the spring 20 is allowed to stretch or extend and thus protects the integrity of the spring using a mechanism corresponding to that previously described in relation to FIG. 16.

FIG. 20 is almost identical to the example of FIG. 19 the only difference is that the body 31 of the bolt 30 has been shortened and the head 32 eliminated, all other aspects are the same as FIG. 19. In this example there is nothing limiting the amount the helical spring 20 can be stretched.

FIG. 21 is a perspective view of the bolt 30 of FIG. 19.

Referring now to FIGS. 22 to 25 in which a high security door guard assembly 1 is provided. In this embodiment the spring damper element of the door frame anchor means 10*s* is recessed into a door frame 'b' and a short length of guard chain 17 is utilised to releasably secure said door frame anchor means 10*s* to a door guard plate generally indicated by 10*k*, the door guard plate being rigidly (fixedly) attached to a door 'a'.

The door frame anchor means 10*s* comprises a fixing plate 22*a* which is a narrow rectangular piece of heavy gauge metal shaped as shown on FIG. 22, a threaded bolt 36 and locknut 37, a compression spring 20, a pivot pin 53 and a guard chain 17, and a triangular shaped engagement means that in use is engage with the door guard plate 10*k*.

The fixing plate 22*a* as shown on FIG. 22 defines an aperture 24 centrally thereon to receive the threaded bolt 36. A pair of screw or bolt receiving apertures 4*a* and 4*b* respectively are also provided in the fixing plate 22*a*, one at each end thereof. The bottom end of the fixing plate 22*a* is bent and fashioned to form a hook 25 (as shown on FIG. 22) on which the triangular shaped engagement means 8*c* on one end of end of a guard chain 17 may be hung when the door guard assembly is not in use.

Referring now to FIGS. 22 and 23, a partially threaded bolt 36 can be seen, the threaded bolt comprises a large head 36*a*, the large head further comprises an aperture 36*d*, said aperture 36*d* being suitable for receiving a pivot pin 53, a deep slot 36*c* is also defined in the large head 36*a* of the bolt 36 said slot 36*c* intersects and crosses the aperture 36*d* and is sized to accommodate a chain link 17*a*. A section of the bolt incorporates a screw thread 36*b* at the opposite end of the bolt 36 to the large head 36*a*, the screw threaded portion of the bolt 36*b* being provided to receive a lock-nut 37. A steel pivot pin 53 (as shown on FIG. 22) that may incorporate a shoulder or boss 53*b* and a large head 53*c*, said pin 53 acts to pivotally secure one end the guard chain 17 to the bolt 36, the shoulder 53*c* acts as a hook to stow the free end of the guard chain 17. The fixing plate 22*a* does not require the hook element 25, as previously referred to with respect to FIG. 22 above, if this type projecting pivot pin 53 is utilised.

The guard chain 17 comprises a short length of chain which further comprises an engagement means (that may be in the form of a triangle 8*c* as shown in FIG. 22 or a ring 8*b* as shown in FIG. 24) secured to the free end of the chain 17. The engagement means, in use, is releasably securable to a door guard plate 10*k*.

To assemble the door frame anchor means 10*s* of FIGS. 22 and 23 the end link 17*a* of a short length of guard chain 17 is first engaged in the slot 36*c* in the bolt 36 and the pivot pin 53 is inserted and passed through said apertures 36*d*, passing through the aperture 17*e* in the link 17*a* until the shoulder 53*b* on the pivot pin 53 abuts the head 36*a* of the bolt 36 when the end of the pin body 53*a* is peened over to fixedly secure the pin 53 to the head of the bolt 36 and one end of the guard chain 17 is thereby pivotally secured to the bolt 36. The fixing plate 22*a* is then loaded onto the threaded bolt 36 followed by the damper spring 20 and the lock-nut 37 is screwed onto the end of the bolt 36 and tightened sufficient to slightly load the spring 20 causing the head 36*a* of the bolt 36 to be spring biased against the front face of the fixing plate 22*a*. A metal triangle 8*c* is then secured to the free end of the guard chain 17, said triangle 8*c* in use, is releasably secured to the guard plate 10*k* which is fixedly attached to a door 'a'.

To fixedly secure the door frame anchor means 10*s* to a door frame 'b' (as shown in FIG. 23 which is a partial cross-sectional view through the door frame 'b' and the door frame anchor means) it is first necessary to drill three spaced holes in vertical alignment in the fixing face of the door frame the fixing plate 22*a* may be used as a guide for this purpose. The middle hole 'y' should be deep enough (sized) to receive the damper spring assembly element. The two outer holes 'z' on either side of the hole 'y' are sized to receive respectively a pair of threaded bolts 9*b* which will engage a pair of metal cross dowel nuts d1 (which will be embedded in the door frame 'b'), as would be known to a skilled person. A further two spaced holes 'x' are drilled into the rebated side of the door frame 'b' at 90 degrees and horizontally aligned with the threaded bolt holes 'z', said pair of bolt holes 'x' are to receive respectively, the cross dowel nuts d1. The cross dowel holes 'x' intersect and pass through the bolt holes 'z' sufficient to permit alignment of the threaded apertures d2 in the cross dowel nuts d1 respectively with the pair of threaded bolts 9*b*. The cross dowel nuts d1 can then be inserted respectively into the cross dowel holes 'x'. The threaded bolts 9*b* may now be loaded onto the fixing plate 22*a*, by means of the apertures 24 and said bolts 9*b* inserted into their respective 'z' holes and screwed tightly into their respective cross dowel nuts d1, to fixedly secure the damper anchor means 10*s* to the door frame 'b'.

The door guard plate 10*k* comprises a generally 'U' shaped, elongated metal bracket provided with a pair of spaced, keyhole shaped bolt receiving apertures (not shown) in the fixing face 91 of the bracket, said fixing face 91 is slightly shorter than the front face 92 of the guard plate 10*k*. The guard plate 10*k* is preferably secured to a door 'a' by means of a pair of coarse threaded, hexagonal headed woodscrews 96, said pair of hexagonal headed screws 96 are screwed almost fully into the fixing face of the door 'a' in the correct position and the guard plate 10*k* is mounted on said pair of screws 96 by means of the larger portions 90*a* of the keyhole shaped apertures (not shown) defined in the fixing face 91, said guard plate 10*k* is then moved transversely forward on the body of the screws 96 until said threaded body 95 of said screws 96 abut the end of the narrow keyhole slot portion (not shown), when the bolts 96 respectively, can be fully and tightly screwed into the door by means of a flat head spanner to fixedly secure the door guard plate 10*k* to the door 'a'. This type of fixing provides that there are no unsightly fixing holes in the front face 92 of the door guard plate 10*k*.

Any force applied to the guard chain 17 attached to the door frame damper enclosure 10*s* will be absorbed by the spring 20 (as shown on FIG. 23), which will cancel out all pressure or impact applied to the door 'a' by a would-be intruder thereby protecting the guard chain 17 and anchor points on the door 'a' and frame 'b' and also prevent possible damage to said door and frame.

FIG. 24 is a part cross sectional view of a spring damper door frame anchor means (as generally indicated by 10*c*) fixedly secured to a door frame 'b' clearly showing the spring damper element of the device recessed into said door frame 'b'. This example is similar to that of FIG. 23 except that the metal bolt 36 which was used in FIG. 23 has been substituted with a wire rope or cable 13*a*. The door frame anchor means of FIG. 24 is, in use, releasably secured to a door handle operatively associated with the door frame 'b'. A large ring 18 is attached to the free end of the guard chain 17, said ring 18 is placed over and around the door handle when the spring damper door frame anchor means 10*c* is in use. In use, the door handle and the spring damper element are not horizontally aligned, the door frame anchor means being positioned vertically above the door handle (not shown) which necessitates the use of a flexible connection means, hence the use of a wire rope 13*a* (as shown on FIG. 24) or drive chain (not shown) is advantageous. If a bolt is used in place of the flexible connection means the spring may not slide smoothly along the bolt due to the guard chain 17 pulling the bolt in a sideways direction, in use.

The door frame anchor means of FIG. 24 comprises a fixing plate 22*a* which is a narrow rectangular piece of heavy gauge metal, a compression spring 20, a short piece of wire rope 13*a* and two ferrules 38, a spring end closure 26, an alloy bush 70, a ferrule enclosure 80, a short length of guard chain 17 and a large ring 18.

The fixing plate 22*a* is provided with an aperture 23 centrally thereon to receive a preferably alloy shouldered bush 70, a pair of screw or bolt receiving apertures 4*a* are also provided in the fixing plate 22*a*, one at each end thereof. The spring end closure 26 (see FIG. 25) is a tubular enclosure with an open end 26*b* the other end 26*c* is generally closed but incorporates a small aperture 26*e* located centrally therein, the aperture (26*e*) is provided to allow for the passage of a wire cable 13*a* through the spring end closure (26). A raised shoulder or boss 26*d* is provided at the open end 26*b* of the closure 26. The body 26*a* of the closure 26 is a snug fit inside the damper spring 20 and the inside diameter of the end closure 26 will accept a metal ferrule 38 (as shown on FIG. 25) which can be attached onto a wire cable 13*a* by means of crimping. The alloy bush or bearing 70 (referring now to FIG. 25) comprises a short length of metal rod defining a main body 71, a raised shoulder or boss 72 is defined (provided) midway along the length of the body, and a small aperture 73 extends longitudinally through the centre of the bush 70, said small aperture 73 is provided to allow passage of the wire cable 13*a* through the body. The body 71 of the bearing 70 is a snug fit within the coil of the damper spring 20 and the aperture 23 in the fixing plate 22*a*. The tubular ferrule enclosure 80 (as shown on FIG. 25) comprises a body 81 and has a closed end 84, a small aperture (not shown) is provided centrally in said closed end 84, the aperture being sized to allow passage of the wire cable 13*a* through the aperture.

To assemble the door frame anchor means 10*c* a metal ferrule 38 is crimped onto one end of a short length of steel cable (wire cable) 13*a*, the free end of said wire cable 13*a* is then inserted into the open end 82 of the ferrule enclosure 80 and said wire cable 13*a* is drawn through the aperture 85 in the closed end 84 in the ferrule enclosure 80 until the ferrule 38 abuts the inside face of said closed end 84. The open end 82 of the ferrule enclosure 80 is then crimped to retain the ferrule 38 captive therein (as shown on FIG. 25). An aperture 86 is then created centrally, in the flat, crimped end of the ferrule enclosure 80, the ferrule shown on FIG. 25 has been crimped and includes the aperture 86. The end link 17*a* of a short length of guard chain 17 is then swivelably secured (by known means) within said aperture 86 of the ferrule enclosure 80 and a large metal ring 18 is then swivelably secured (by known means) to the free end of the guard chain 17, said large ring 18, in use, is placed on and around a door handle. The bearing or bush 70 is then mounted in the central aperture 24 in the fixing plate 22*a* and the free end of the wire cable 13*a* is inserted and drawn through the central aperture 73 in the bearing 70 until the ferrule enclosure 80 abuts the front face of the fixing plate 22*a*. The damper spring 20 is then mounted on the body 71 of the bearing 70 leaving the wire cable 13*a* protruding outward of the free end of the damper spring 20. The spring end closure 26 is loaded onto the wire cable 13*a*, said cable 13*a* passing through the central aperture 26*e* in the spring end enclosure 26 and the raised shoulder 26*d* abuts the free end of the damper spring 20, when the body 26*a* of the end closure 26 extends within the damper spring 20. By means of a jig or tool the spring 20 is compressed and a ferrule 38 is crimped onto the wire cable 13*a* such the when the spring 20 is released from the jig and allowed to extend in length the ferrule 38 is drawn through the aperture 26*b* to locate within the spring end closure 26 and to abut the inner surface of the closed end 26*c*. The wire cable 13*a* is now lightly loaded which acts to spring bias the ferrule enclosure 80 against the outer surface of the fixing plate 22*a*. The door frame anchor means 10*c* is now full assembled and ready to be fixedly secured to a door frame 'b'.

The door frame anchor means 10*c*, is then secured and positioned on a door frame 'b' such that the large ring 18 can be slipped onto the door handle when said handle is in its horizontal position, when the handle is depressed the ring 18 cannot disengage the door handle. Engaging the ring 18 on and around the door handle allows the door 'a' to be securely opened a small distance for permitted inspection of a caller but prevents unwanted entry, after inspection the door 'a' must be closed to permit removal of the ring 18 from the door handle before the door 'a' can be fully opened. Any pulling force applied to the free end of the guard chain 17, due to a potential intruder trying to force the door open will cause compression of the spring 20, such that the spring absorbs and cancel out said force.

A plastic grommet (not shown) may be fitted to the large ring 18 to prevent the ring 18 marking or damaging the door handle, a door edge protection strip (not shown) may also be provided. A short length of nylon sleeving (not shown) may enclose three or four chain links adjacent the ring 18.

Reference is now made to FIGS. 26 and 27 in which a key lockable, spring damper door guard assembly (as generally indicated by 1*z*) is shown. FIG. 26 is a part cross sectional front view of the complete assembly (1*z*), shown in its inoperative condition fixedly secured to a door 'a' and door frame 'b'.

The door guard plate 10*d* comprises a fixing plate 100, a spring enclosure plate generally indicated by 110, a compression spring 20, a guard chain 17, a spring compressing plate 8*e* and ring 8*b*. The fixing plate generally indicated by 100 is in the form of a metal plate comprising a main body portion 101 from which a wall portion 104 depends outward at angle of approximately 90 degrees to said main body 101 (as can be seen on FIG. 33 which is a partial sectional view of the plate 100). The wall 104 is located approximately a quarter of the way along the length of the fixing plate 100 (as shown in FIG. 26), from the end of the plate, and acts as an abutment or stop face for the spring 20. An aperture 103 in said wall 104 allows for passage of the guard chain 17 through the wall 104. A pair of opposing screw fixing apertures are provided at the front end (the end of the plate closest to the vertical edge of the door in use) of the fixing plate 100 and a further six spaced apertures—three on each side of the fixing plate 100—are also provided. The apertures facilitate the attachment of the fixing plate to a door 'a' with screws 9. A pair of vertically opposed apertures 24*b* respectively are provided on each flange portion 114 of the enclosure plate 110 for assembly purposes, said apertures 24*b* facilitate the attachment of the enclosure plate 110 to the fixing plate 100, the apertures 24*b* align with a pair of vertically opposed threaded aperture (not visible) in the fixing plate 100. Fixing plate 100 and enclosure plate 110 are secured to each other by the threaded bolts 9*c*.

The spring enclosure plate 110 (as shown in FIG. 27) is in the form of a tubular housing, the front end 112 of said enclosure plate 110 is open providing access 115 to the interior of the housing, the other end of the enclosure defines a closed end 113. A pair of opposing flanges 114 depend outwardly from and on each side of the tubular body 111, each of said flanges 114 respectively define three screw receiving apertures 24*a* said apertures 24*a* are arranged to align with corresponding apertures in the fixing plate 100, and such that when the fixing plate 100 and spring enclosure plate 110 are placed together for assembly the same fixing screws 9 secure the fixing plate and cover plate assembly to the fixing surface of a door 'a'. A hook 25 is incorporated and projects from the closed end 113 of the enclosure plate 110, said hook 25 being provided as a means to hang or stow the ring 8*b* (or a link 17*a* or metal plate 17*c* as described below) attached to the free end of the guard chain 17 when the door guard assembly 1 is not operational. The enclosure plate 110 may be fabricated from a suitable plastic material.

To assemble the door guard plate 10*d* first attach the metal spring compressing plate 8*e* to one end of a short length of guard chain 17 and then load the spring 20 onto said guard chain 17 so that one end of the spring 20 abuts the metal plate 8*e*. The end of the guard chain 17 supporting the spring 20 is then lowered into the housing 115 in the enclosure plate 110 so that the metal plate 8*e* abuts the closed end 113 of the housing 115. The exposed portion of guard chain 17 is then drawn through the aperture 103 in the wall 104 of the fixing plate 100 and a ring 8*b* may be attached to the free end of the guard chain 17. The enclosure plate 110 is then placed against the body 101 of said fixing plate, with its front end 112 abutting the wall 104, a pair of threaded bolts 9*c* engage the pair of apertures 24*b* in the enclosure plate 110, and the bolts 9*c* are then screwed into the threaded apertures in the fixing plate 100 to secure the door guard plate assembly together prior to it being attached to a door 'a', in use. Alternatively rivets, not shown, may be used in place of the threaded bolts 9*c* to secure the enclosure plate 110 to the fixing plate 100. Preferably, after assembly the spring 20 is slightly loaded against the wall 104 on the fixing plate 100. Any pulling force applied to the free end of the guard chain 17 will cause the metal plate 8*e* to compress the spring 20 which will absorb and cancel out said force.

A short length of nylon sleeving (not shown) may be applied to the exposed links of the guard chain 17 prior to the ring 8*b* (or metal plate 17*d*) being secured to the free end of the guard chain 17.

Figure 37:
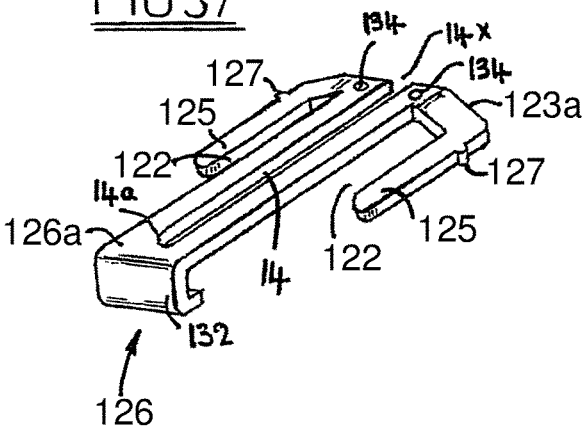
FIG. 37 is a perspective view of the spring compressing member shown in FIGS. 34 to 36.

In this embodiment, a key lockable, rigid, door frame anchor means 10*di* is illustrated in conjunction with the spring damper door guard plate 10*d*, said lockable door frame anchor means 10*di* is identical to that shown in FIG. 37, the only difference being that the hook 25 which is used to stow the chain 17 is not required in this example as the ring 8*b* is stowed on the hook 25 defined on the enclosure plate 110. The key locking door frame anchor means 10*di* as shown in FIG. 26 is described further within the embodiments shown in FIGS. 39 to 54. In this embodiment a key (not shown) is required to engage and disengage the guard chain 17 from the door frame anchor means 10*di*. The key should therefore be at hand at all times. The key must be removed from the door frame anchor means 10*di* when the door guard assembly is in use.

The key lockable, damper door guard assembly 1*z*, as illustrated in FIG. 26 is shown in an inoperative condition wherein the guard chain 17 is shown hanging vertically from the door guard plate 10*d* (when normally the ring 8*b* on the free end of the guard chain 17 would be located on the hook 25 on the spring damper door guard plate 100 when the device is not in use). The locking bolt 160*a* on the door frame anchor means 10*d* is in its lower position leaving the slot 137 clear and ready to receive the ring 8*b* (or link 17*a* or metal plate 17*d*).

To lock the door guard assembly 1*z*, the ring 8*b* is inserted into the slot 137, the locking bolt 160*a* is then raised to its second "locking" position, in which position the locking bolt 160*a* has passed through the aperture 17*e* in the ring 8*b* and the key 200 (not shown) is then turned, rotating the barrel lock (generally indicated by 150) and said key 200 is removed, to lock the bolt 160*a* in its second position thus securing the free end of the guard chain 17 by means of the ring 8*b* (and thereby the spring damper door guard means 10*d*) to the door frame anchor means 10*di*. The ring 8*b* being releasable by use of the key to unlock the bolt 160*a*.

Figure 38:
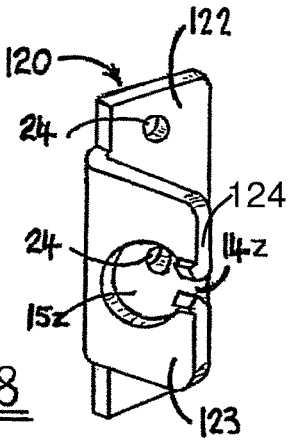
FIG. 38 illustrates a door frame anchor bracket for use with the spring damper door guard assemblies illustrated in FIGS. 28 to 32.
Figure 39:
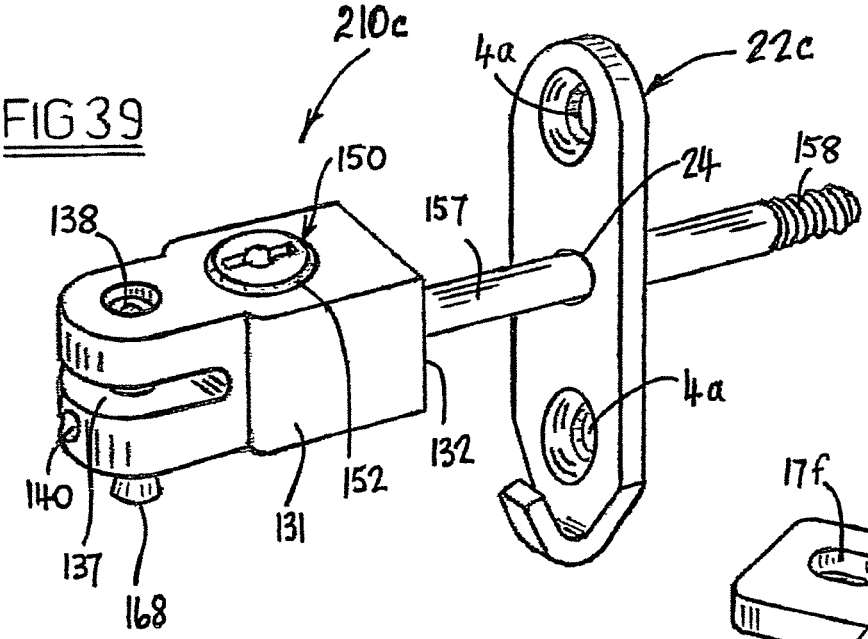
FIG. 39 illustrates a perspective view of a key lockable door frame spring damper anchor means of the type used by the door guard assembly illustrated in FIG. 26.

The door frame anchor bracket 120 illustrated in FIG. 38 may be used in conjunction with the above described door guard plate 1*z* to provide a non-lockable door guard assembly. The guard chain 17 would be provided with a metal plate 17*c*, normally interposed in the guard chain 17 between the second and third links from the wall 104 of the fixing plate 100, said metal plate 17*c* allowing the guard chain 17 to be engaged within the larger slot end aperture 15 of the door frame anchor bracket 120. The door frame anchor bracket 120 is described below in detail in relation to FIGS. 28 to 30.

FIGS. 28 to 30 illustrate a spring damper door guard assembly, as generally indicated by 1*x* on FIG. 28, which is similar to the previous embodiment shown in FIGS. 26 and 27. FIG. 28 is a front view of the complete door guard assembly 1*x* in its inoperative condition, showing the ring 8*b* on the free end of the guard chain 17 engaged on a hook 25*a* on the spring enclosure 110*a*. FIG. 29 is a partial cross sectional view of the door guard plate (generally indicated by 10*x*) clearly showing two spring compressing plates 8*e*, the springs 20 have been omitted on FIG. 29 for the sake of clarity. The spring compression plates 8*e* are shown in alternative orientations in FIG. 28 and in FIG. 29. FIG. 30 is a partial cross sectional view of the door guard plate showing the spring enclosure 110*a* attached to the fixing plate 100*a* such attachment being normally made by means of the self-tapping screws 9*e*.

In this example two compression springs 20 are arranged to operate in parallel and the wall 104*a* of the fixing plate 100*a* defines a pair of spaced apertures 103*a* respectively to allow passage of two lengths of chain 17. The spring enclosure 110*a* defines two U shaped chambers 115*a* (U shaped when viewed from the end of the spring enclosure) sized to accommodate the pair of springs 20, the end walls 113*a* of said chambers 115*a*, that are located at the end of the spring enclosure that is distal from the fixing plate wall 104*a*, form an end closure means to the chambers. Spaced screw fixing apertures 24 are provided in the fixing plate 100*a*. A pair of spaced apertures 24 are provided at the front of the fixing plate 100*a* and a further three spaced apertures 24 are provided centrally and longitudinally in the spring enclosure 110*a* between the spring enclosing chambers 115*a*, said apertures 24*a* align with the apertures 24 in the fixing plate 100*a* to allow the door guard assembly 10*x* to be fixedly secured to a door 'a' with screws 9 (usually wood-screws).

A hook 25 is provided on the spring enclosure 110*a* on which to hang the free end of the guard chain 17.

To assemble the spring damper door guard plate 10*x*, the end links 17*a* of three lengths of guard chain 17 are secured within a ring 8*b*, the ring 8*b* is also attached to the free end of the longer length of guard chain 17. A metal plate 17*c* which is generally similar in length and diameter to one of the links of the chain is provided in the longer length of chain 17 to bridge the link 17*a* which is secured to the ring 8*b*, said metal plate 17*c* is of a thickness that allows the guard chain 17 to be engaged within the larger slot end 15*z* in the door frame anchor bracket 120.

The fixing plate 100*a* and the two compression spring 20 respectively, are loaded onto a special assembly jig, one end of each spring 20 is centrally aligned with the pair of apertures 103*a* in the wall 104*a* of the fixing plate 100*a*, wherein the springs 20 are compressed against said wall 104*a*. The free ends of the two short lengths of guard chain 17 are passed through the apertures 103*a* respectively in the wall 104*a* and through the centre of the springs 20 and a spring compressing plate 8*e* is attached to the free end of each short length of guard chain 17. The fixing plate 100*a*, guard chain 17 and spring 20 assembly is then released from the special jig when the springs 20 are released from compression, said springs 20 are lightly loaded respectively against the compressing plates 8*e* causing the ring 8*b* to be spring biased against the wall 104*a* of the fixing plate 100*a*.

The spring enclosure 110*a* is then placed against the body 101*a* of the fixing plate 100*a* with its open end 112*a* abutting the wall 104*a*, a self-tapping screw 9*e* is inserted through an aperture 24*c* from the back side of the fixing plate 100*a* and said screw 9*e* is screwed fully into a blind bore 24*d* (shown on FIG. 28) in the enclosure plate 110*a* to attach the fixing plate 100*a* to the spring enclosure 110*a*. The spring damper door guard plate is now fully assembled.

The door frame anchor bracket 120 (shown in FIG. 38) comprises a angle plate having a first side 122 which is provided with 3 spaced screw or bolt fixing apertures 24 by means of which said bracket 120 is secured to a door frame 'b'. The second side 123 (preferably at an angle of 75 degrees to the first side 122) of the anchor bracket 120 may be shorter than the first side 122 and defines a narrow slot 14*z* leading from the centre of its outer edge 124 to a larger slot end aperture 15*z*. The link sized metal plate 17*c* provided on the guard chain 17 may be passed through the narrow slot 14*z* in the second side 123 of the bracket 120, allowing the guard chain 17 to be engaged within the larger slot end aperture 15*z*. In use, the guard chain 17 would then be drawn through the larger slot end aperture 15*z* until the ring 8*b* on the free end of the guard chain 17 abuts the second side 123 of the anchor bracket 120 as the ring 8*b* will not pass through the larger slot end aperture 15*z* or the narrow slot 14*z* in the angled side 123 of the anchor bracket 120. The spring damper door guard plate 10*x* is then secured to the door frame anchor bracket 120 such that it can be released by a user when required.

The lockable, rigid, non-damper door frame anchor means 10*z* and 10*f* of FIGS. 46 and 52 may also be used in conjunction with the above spring damper door guard plate 10*w*.

FIGS. 31 to 33 illustrate a spring damper door guard assembly (as generally indicated by 1*w*) which is almost identical to the previous embodiment of FIGS. 28 to 30. In this example a steel cable 13*a* extends through the pair of compression springs 20 that are arranged to operate in parallel. FIG. 31 is a partial cross sectional front view of the door guard assembly 1*w* fixedly secured to a door 'a' and door frame 'b' and in its second operative condition, the guard chain 17 having been releasably secured in the door frame anchor bracket 120, the ring 8*b* will not pass through the larger slot end aperture 15*z* in the anchor bracket 120. FIG. 32 is a front view of a sub-assembly comprising the fixing plate 100*b*, guard chain 17, steel cable 13*a*, compression springs 20, spring end closures 26 and ferrules 38, prior to the spring enclosure 110*b* being secured thereto.

The spring enclosure 110*b* defines two U shaped chambers 115*b*, as shown on FIG. 31, to accommodate the pair of springs 20 (as described above with reference to FIG. 31, a wall 113*b* closes one end of said chambers 115*b*, the open end (not shown) of the spring enclosure 110*b* allows the springs 20 to abut the wall 104*b* of the fixing plate 100*b*. A pair of spaced screw fixing apertures 24 are provided in the front end of the fixing plate 100*b* to receive wood screws 9, three further screw fixing apertures 24 are also provided in the fixing plate 100*b* located centrally and longitudinally therein, also to receive screws 9 (usually wood screws). Three screw fixing apertures 24*a* are also provided, located centrally and longitudinally, in the spring enclosure 110*b* between the spring enclosure chambers 115*b*, said apertures 24*a* align with the apertures 24 in the fixing plate 100*b* to allow the door guard assembly 10*w* to be fixedly secured to a door 'a' with screws (normally wood screws).

A hook (not shown) may also be provided on the spring enclosure 110*b* on which to hang the free end of the guard chain 17.

To assemble the spring damper door guard plate, as generally indicated by 10*w* on FIG. 31, the fixing plate 100*b* as shown in FIG. 33 and the two compression spring 20, which have a spring end closure 26 (as previously described with reference to FIG. 25) engaged in one end of each spring 20 respectively, are loaded onto a special assembly jig, the open ends of the springs 20 respectively are aligned to the slot 103*b* in the wall 104*b* of the fixing plate 100*b*. The springs 20 are then compressed against the said wall 104*b*. A metal ferrule 38 (as previously described with reference to FIG. 25) is crimped onto the end of a short length of steel cable 13*a* and the free end of the cable 13*a* is then passed through the apertures 26*d* and 26*e* in one of the spring end closures 26 which are engaged in the ends of the springs 20, said free end of the steel cable 13*a* is then passed through the first spring 20 and the slot 103*b* in the wall 104*b* of the fixing plate 100*b*, until the ferrule 38 locates within the spring end enclosure 26 abutting the inner side of the closed end 26*c*. The free end of the steel cable 13*a* is then passed through the aperture 17*e* in the end link 17*a* of a short length of guard chain 17 thereby attaching said guard chain 17 to the steel cable 13*a*. A ring 8*b* is connected to the other end of said guard chain 17. The free end of the steel cable 13*a* is then passed back through the slot 103*b* in the fixing plate 100*b*, and through the second spring 20 and spring end closure 26 then a ferrule 38 is crimped onto the said free end of the steel cable 13*a*.

The fixing plate 100*b*, steel cable 13*a*, ferrules and spring end closures 26 assembly is then removed from the special jig releasing the springs 20 from compression which causes the second ferrule 38 to be drawn into the second spring end closure 26 to abut the inner side of the closed end 26*c*. The compression springs 20 still remain lightly loaded respectively against the spring end closures 26 causing the link 17*a* of the guard chain 17 to be lightly spring biased against the wall 104*b* of the fixing plate 100*b* (see FIG. 32).

The spring enclosure 110*b* is then placed against the body 101*b* of the fixing plate 100*b* with its open end 112*b* abutting the wall 104*b*, a countersunk self-tapping screw 9*e* is inserted through the countersunk aperture 24*c* from the back side of the fixing plate 100*b*, and said screw 9*e* is screwed fully into a blind bore (24*d*, shown by dotted lines on FIG. 31) in the enclosure plate 110*b* to attach the fixing plate 100*b* to the spring enclosure 110*b*. The spring damper door guard plate is now fully assembled (as shown in FIG. 31).

The link sized metal plate 17*c* facilitates engagement of the guard chain 17 in the door frame anchor bracket 120 said metal plate 17*c* passing through the narrow slot 14 when the guard chain 17 is drawn through the aperture 15*z* until the ring 8*b* abuts the wall 123 of the anchor bracket 120, to place the door guard assembly 1*w* in its operational or standby condition (as shown in FIG. 31).

FIG. 38 is a perspective view of the door frame anchor bracket 120 that may be used in combination with the spring damper door guard plate 10*w*, as shown in FIG. 31).

The lockable, rigid, non-damper door frame anchor means 10*z* and 10*f* of FIGS. 46 and 52 may also be used in conjunction with the above spring damper door guard plate 10*d*.

FIGS. 34 to 38 illustrate a spring damper door guard assembly (as generally indicated by 1*v* on FIG. 34) which is similar to the previous embodiment as shown and described with reference to FIGS. 31 to 33. In this example, the spring damper door guard plate (as generally indicated by 10*v* on FIG. 34) comprises a pair of compression springs 20 that are arranged to operate in parallel and the wall 104*c* of the fixing plate 100*c* is not provided with any apertures of the type discussed above, i.e. apertures 103 of the type incorporated in the embodiments shown in FIGS. 26 and 28 are not included.

Figure 34:
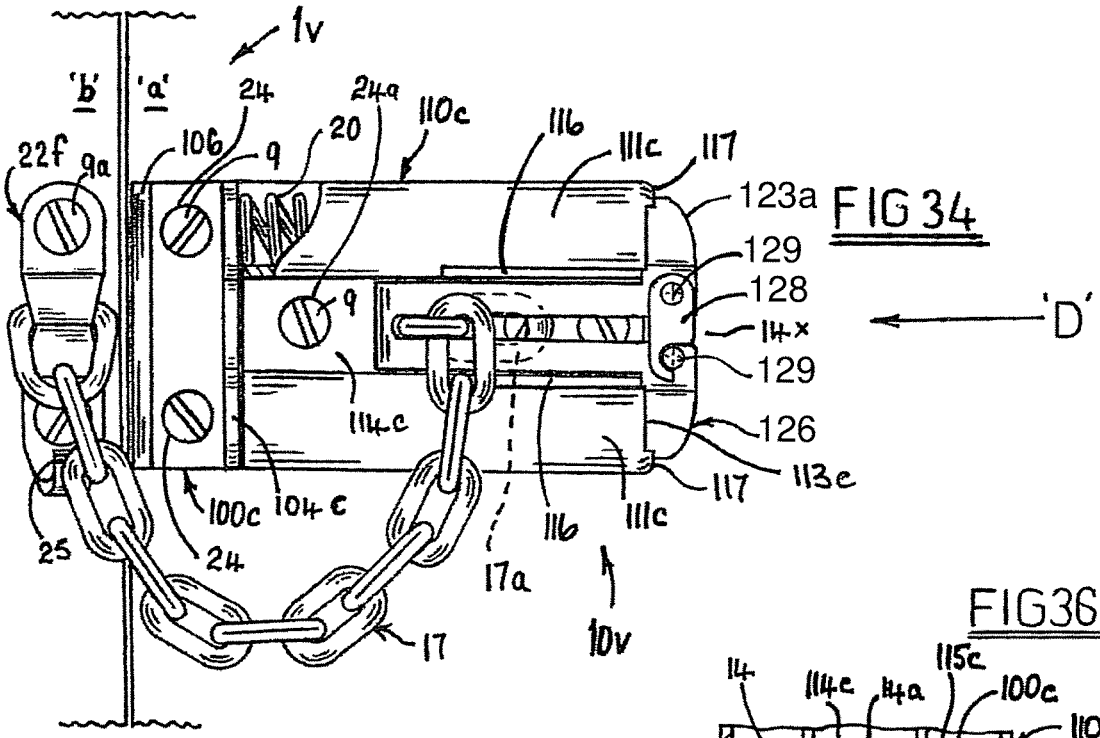
FIG. 34 illustrates a further embodiment of door guard assembly comprising a spring damper door guard assembly incorporating two springs.
Figure 36:
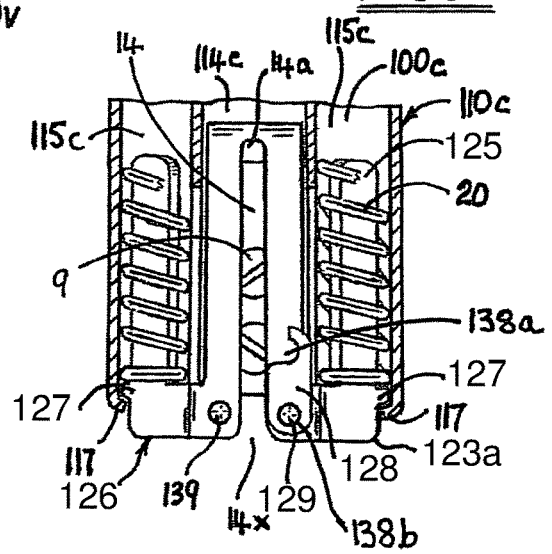
FIG. 36 is a partial cross-sectional plan view of the spring damper door guard assembly illustrated in FIG. 35.
Figure 35:
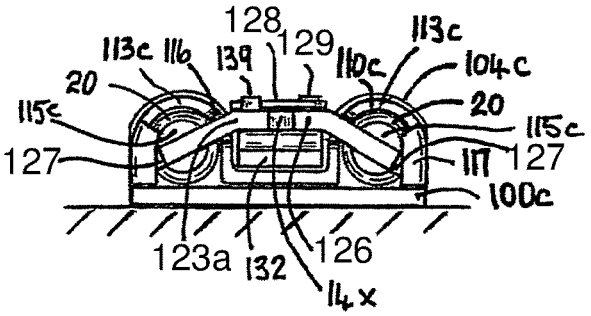
FIG. 35 is a partial cross-sectional end view of the spring damper door guard plate illustrated in FIG. 34.

FIG. 34 is a front view showing the door guard assembly 1*v* fixedly secured to a door 'a' and door frame 'b' and in its operational or standby condition, the last link 17*a* on the free end of the guard chain 17 has been engaged in a slot 14 (as can be seen on FIG. 36) in the spring compressor member 126 of the door guard plate, the end of the chain 17 may be disengaged from the slot 14 if the door needs to be fully opened. A rigid door frame anchor plate 22*f*, of the type illustrated in FIG. 66, is suitable for use with the spring damper door guard plate 10*v* (as described in this embodiment). FIG. 35 is an end view of the assembled door guard plate of FIG. 34, as viewed in the direction of arrow D on FIG. 34. FIG. 36 is a partial cross sectional view of the assembled guard plate of FIG. 34. FIG. 37 is a perspective view of the spring compressor member 126, minus the swivel bracket 128.

The spring enclosure 110*c* comprises two U shaped chambers 115*c* (the chamber being U shaped when viewed from the open end of the spring enclosure in the direction of the arrow D on FIG. 34) depending from the body 114*c*, said U shaped chambers 115*c* accommodate a pair of springs 20, one end of the springs 113*c* are visible on FIG. 35. The outer walls 111*c* at one end 113*c* of the spring enclosure 110*c* comprise two sections that are folded over to form lips (as indicated by 117), these lips 117 retain the spring compression member and the associated springs within the spring enclosure 110*c* when the various components are assembled together to form the spring damper door guard plate 10*v*. The other end of the two chamber 115*c*, is closed off when the spring damper guard plate 10*v* is assembled, by the wall 104*c* of the fixing plate. The spring compressing member 126 is engaged with the spring enclosure 110*c* by means of the inter-engagement of the projections 127 incorporated onto parallel arms 125 which engage with the lips 117 on the outer walls 111*c* of the spring enclosure 110*c*. The projections 127 are sized such that they provide an interference fit with the lips 117 of the spring enclosure, i.e. they provide a snap fitting of the projections 127 with the lips 117.

A pair of slots 116, are provided in the inner side of the walls 111*c* of the spring enclosure, these slots 116 extend from the back end 113*c* of the spring enclosure 110*c* said slots 116 capture and in combination with the fixing plate 100*c* guide the back end 123*a* of the spring compressing member 126 within the chamber formed by the assembled fixing plate 100*c* and spring enclosure 110*c*. Preferably, forward movement of the spring compressing member 126 is arrested by full compression of the springs 20 or alternatively by the arms 125 on the spring compressing member 126 abutting the wall 104*c* on the fixing plate 100*c*. A chamfered edge 106 is provided on the front edge of the fixing plate 100*c* to prevent abrasion of the steel cable 13*a*. A lip may be provided as an alternative to the chamfered edge 106.

A pair of spaced screw fixing apertures 24 are provided in the front of the fixing plate 100*c* to receive screws and three spaced screw fixing apertures 24*a* (one of which is shown) are also provided located centrally and longitudinally in the fixing plate 100*c*, said three spaced apertures 24*a* are arranged to align with three corresponding spaced apertures 24*b* defined centrally and longitudinally in the body 114*c* of the spring enclosure 110*c*. Once the aperture on the fixing plate 24*a* and the corresponding apertures on the spring enclosure (not shown) are aligned, these assembled components may be affixed to the door with screws 9; at this stage it should be noted that the springs 20 will be located within the chambers 115*c* formed by the assembly of the fixing plate 100*c* and the spring enclosure 110*c*. The assembly formed by the fixing plate 100*c*, the spring enclosure 110*c* and the springs 20 may then be mounted on a door; the arms 122 of the spring compressing member 126 are then inserted into position within the assembly such that they engage the spring 20, and the projections 127 engage with the lips 117 are by means of said snap fitting. In this way the spring compressing member 126 is retained within the spring damper door guard plate assembly 10*v* with the projections 127.

A threaded aperture (not shown) is located centrally in the fixing plate 100*c* and a corresponding countersunk aperture is provided centrally in the spring enclosure 110*c* to facilitate the attaching said spring enclosure 110*c* to the fixing plate 100*c* by means of a threaded bolt (not shown). The spring compressing member 126 is normally only inserted into the combined door fixing plate 100*c* and spring enclosure 110*c* assembly (to form the door guard assembly 10*v*) after this assembly has been fixedly secured to a door 'a'.

A spring compressing member 126 (as shown in FIG. 37) may be provided in the form of a metal pressing/pressed metal plate, said spring compressing member 126 defines an elongated central body (generally indicated by 126*a*) that may be comprised of two elongate arms (as indicated by 131*a* on FIG. 37), further comprising two shorter parallel arms 125 extending from the back end 123*a* of the spring compressing member, one arm being located on each side of the central body 126*a*. A narrow gap 122 is provided between said central body 126*a* and arms 125, said arms 125 are to locate and support the pair of compression springs 20 respectively. The central body 126*a* also comprises a long (elongate) narrow slot 14 located centrally and transversely in the central body 126*a*, said slot 14 extending from the back end 123*a* of the body 126*a*, as indicated by 14*x*, to close to the front end 132 of said body 126*a* as indicated by 14*a*. The long (elongate) slot 14 facilitates entry and engagement of a selected link on the free end of a guard chain 17, the other end of said guard chain 17 is fixedly secured to a door frame anchor plate 22*e* or 22*f* (the anchor plates shown in FIGS. 64 and 66 are suitable for use with this embodiment of the spring damper door guard plate 10*v*). The extremity of the front end 132 of the central body 126*a*, close to the end of the narrow slot indicated by 14*a* of the spring compressor 126, is bent to provide a guide and support for said spring compressor 126 in use. The width of the slot 14 generally corresponds in size to the thickness of a chain link, such that a chain link may be inserted into the slot 14, in use, via the end 14*x*.

A pair of spaced apertures 124*a* are provided in the back end 123*a* of the spring compressor 126 to facilitate the mounting of a locking latch 128, said apertures 124*a* are located one on each side of the narrow slot 14 to receive respectively one each of a pair of identical pivot pins 129. When installed the pivot pins 129 protrude outward of the spring compressor body 126*a* such that a latching means (latch) 128 may be pivotally located on either one of the pivot pins 129. The latch further comprising a cut-out section 138*a* at one end, and an aperture 138*b* at the other end that is sized allow the latch to be located on one of said pivot pins 129. The latch 128 is pivotally engaged on one of the pivot pins 129 the other pivot pin 129 functions as an abutment stop for the latch 128 such that the cut-out section 138*a*, in use, abuts and partially encircles the other pivot pin when the latch 128 is in its closed position, as shown on FIG. 34. The function of the latch 128 is to retain the free end of the guard chain 17 in the narrow slot 14 said latch 128 opens inwards of the slot 14 to allow entry of the guard chain 17 and closes to prevent inadvertent disengagement of the free end of said guard chain 17 from the slot 14. The latch 128 is biased such that it will automatically return to its closed locking position under gravity. Determining whether the door opens to the right or left dictates which pivot pin 129 is used as a pivot and which pivot pin is used as an abutment stop for the latch 128. The pivot pins 129 are preferably fabricated from a suitable plastic material. The latch 128 comprises a small oval metal plate defining a latch cut-out 138*a* at one end the other end of the latch 128 is provided with an aperture to receive a pivot pin 129. FIG. 34 shows the latch 128 in its closed, locking position and in FIG. 36 the latch 128 is depicted in its open position.

In use, the free end of the guard chain 17 is removed from the hook 25 on the door frame anchor plate 22*f* and a link of the chain is selected for engagement in the narrow slot 14 in the spring compressor 126. It should be noted that any of the links of the chain 17 (except the end link 17*a*) that can reach the end of the slot 14*x* may be inserted into the slot; obviously, the end link of the chain may not be used as the inserted links engagement with the slot is maintained by the next link in the chain being unable to pass through the slot whilst it is engaged with the link inserted into the slot. The interior of the spring compressor body 126*a* provides a large enough opening to accommodate one or more links such that they do not interfere with the working of the assembled spring damper door guard assembly 1*v*. The selected link of the guard chain 17 is slid past the gravity latch 128 to abut the slot end 14*a*, said latch 128 will automatically move back to its closed position under gravity. The door guard assembly 1 is now in its first operative or standby condition. Any force applied to the door 'a' would cause the guard chain 17 to pull on the spring compressor 126 which would absorb the force via the springs 20. The latch 128 prevents the chain 17 from being accidently disengaged from the narrow slot 14 in use, or when an intruder is applies force to a door to which the assembly is attached and in use—the rapid release of pressure applied to a door can result in the engaged chain suddenly sliding to the opposite end of the slot (14*x*).

Referring now to FIGS. 39 to 54, which relate to a key lockable door guard assembly 1. The provision of a lockable door guard assembly allows a key holder to unlock and release the guard chain 17 from the door frame anchor means, from the opposite side of the door to the side on which the assembly has been affixed in use, i.e. from outside a house and such that the key holder may enter the house.

FIGS. 39 to 44 illustrate a lockable spring damper, door frame anchor means in which the spring damper element, in use, is recessed into a door frame 'b'. The end link 17*a* of the guard chain 17 is shown secured to the door frame anchor means shown in FIG. 40. Once the door frame anchor means 210*c* has been fixedly secured to a door 'a', said guard chain 17 can only be disengaged from said anchor means 210*c* by use of a key 200. The free end of the guard chain 17, in use, is intended to be secured to a suitable door guard plate (e.g. 10*g*, 10*h* or 10*k* affixed on a door 'a' that is operatively associated with said door frame 'b' (see FIGS. 53 and 54), such that the guard chain may be released from the door guard plate (10*g*, 10*h* or 10*k*) by a user located on the same side of the door to which the door plate is affixed. In normal use, one end of the guard chain 17 remains fixedly secured to the door frame anchor means 210*c* and would only be released by, for example, by a family member or carer in possession of a key 200 who needed to access the house when the door guard assembly 1 was operational and they are opening the door from the opposite side to the side on which the door guard assembly 1 is affixed.

The lockable door frame anchor means 210*c* illustrated in FIGS. 39 to 44 incorporating a spring damper element comprises a short generally rectangular metal body 147 and having a rod portion 157 depending outwardly and centrally from the rear surface 132 of said body 147, a screw thread 158 is defined at the free end of the rod portion 157 to receive a threaded nut 159. A vertical, through aperture 148 is provided in the body 147 said aperture 148 is adjacent the rear surface 132. The aperture 148 serves to house a barrel lock 150. A deep horizontal through slot 146 is defined centrally in the front face 149*c* of the body 147 said slot 146 to provide entry for a chain link 17*a* or metal plate 17*d* on one end of a guard chain 17. Another aperture 145 is provided in the top surface 133 of the body 147 centrally thereon and close to the front face 149*c* said aperture 145 providing entry to the horizontal slot 146, a further aperture 149*b* which has a slightly smaller inside diameter than the aperture 145 is provided in the body 147 in vertical alignment with said aperture 145 and in the bottom surface 149 of the body 147 to again provide access to the horizontal through slot 146.

A chamfer 140 is defined in the entry to the aperture 149*b* adjacent to the horizontal through slot 146. The vertically aligned apertures 145 and 149*b* are to receive a captive locking bolt 160, said bolt 160, in use, will releasably secure the end link 17*a* or metal plate 17*d* of the guard chain 17 to the door frame anchor means 210*c*. A horizontal bore 141 is located centrally in the front face 149*c* of the body 147 said bore 141 extends inwards of said front face 149*c* to intersect the vertical aperture 149*b* and serves to provide access to the barrel lock aperture 148.

A fixing plate 22*c* is provided, which comprises a narrow rectangular piece of heavy gauge metal, an aperture 24 is provided centrally thereon to receive the threaded rod 157 attached to the body 147. A pair of screw or bolt receiving apertures 4*a* are also provided in the fixing plate 22*c*, one at each end thereof. The bottom end of the fixing plate 22*c* is bent to form a hook 25 on which to hang the free end of the guard chain 17.

A barrel lock 150 is provided to facilitate key locking of a guard chain 17 in the door frame anchor means 210*c* said barrel lock 150 supports the conventional tumblers and associated springs. The key receiving end of the barrel lock 150 defines a shoulder 152 and a small, short key 153 depends downwards from said shoulder 152, the key 153 locates in the cut-out 142 in the entry to the lock receiving aperture 148 said key 153 governs or restricts rotational movement of the barrel lock 150 in the aperture 148 by engagement with the stop faces 144 and 144*a* respectively. A pair of opposing vertical cut-outs 143, are defined in the wall of the aperture 148 to accommodate movement of the lock tumblers. A cam surface 154 is provided in the lock body 151 in the end of said body opposite the key receiving end.

A locking bolt 160 is provided which is slidably mounted in apertures 145 and 149*b* in the body 147 of the door frame anchor means 210*c* to releasably engage and secure one end of a short length of chain 17 to said anchor means 210*c*. The locking bolt 160 comprises a main body portion 161 one end of which defines a tapered shoulder 162 the outside diameter of said shoulder 162 is slightly larger in diameter than the body 161 said shoulder 162 will nest snugly in the chamfer 140 defined in the bolt receiving aperture 149*b*, the other end of the bolt 160 has a reduced diameter portion 163 to receive a handle 168, said handle 168 has a tapered through hole 169 to facilitate its mounting on the reduced portion 163 on the bolt 160. An annular recess or groove 164 is provided in the bolt body 161 close to the reduced diameter portion 163.

FIG. 43 best illustrates the spring damper door frame anchor means 210*c* shown in FIGS. 39 to 44 when all its locking components are assembled in the body 147. The locking bolt 160 is depicted in its raised "locking" position, the ball bearing 177 is spring biased into engagement in the annular recess or groove 164 in the bolt 160 and the cam follower 170 is spring biased against the cam surface 154 defined in the body 151 of the barrel lock 150 (see view 'a' of FIG. 45) there remains a small gap 178 between the ball bearing 177 and cam follower 170 which indicates the device is not locked but the tension between the ball bearing 177 and bolt 160 is sufficient to hold said bolt 160 in its raised locking position. In order to lock the bolt 160 a key must be engaged in the barrel lock 150 and turned 180 degrees this action rotates the barrel lock 150 in the aperture 148 between stop faces 144 and 144*a* and relative to the body 147, the action of turning the barrel lock 150 causes the cam surfaces 154 to move the cam follower 170 Transversely within the bore 141 when the ball bearing 177, cam follower 170 and cam 154 assume the position illustrated in view 'b' FIG. 38, in which position the gap 178 has been closed and the ball bearing 177 is lockingly engaged in the annular recess 164 in the bolt 160 effectively locking the bolt 160 against vertical movement relative to the body 147. The cam follower 170 cannot disengage the barrel lock 150 and thereby acts to retain said lock 150 in the body 147. Removing the key 200 from the lock 150 prevents rotation of the barrel lock in the body 147.

The locking bolt 160 is assembled into the body 147 via the aperture 145 to extend outward from the bottom surface 149 of the body 147 when the handle 168 may be mounted onto the reduced diameter portion 163 of the bolt 160 the free end of said portion 163 is accessible through the tapered hole 169 in said handle 168 and facilitates the end of the reduced diameter portion 163 to be spun or spread in order to render the handle 168 captive on the bolt 160 and the bolt 160 captive in the aperture 149*b*. The handle 168 is used to manipulate the bolt 160, however, should any pulling forces be applied to the handle 168 it will break free of the bolt 160 acting much like a sheer pin, to prevent removal of the bolt 160.

FIG. 40 shows the lockable door frame anchor means 210*c* of FIGS. 39 to 44 fixedly secured to a door frame the fixing plate 22*c* and damper spring 20 having been loaded onto the threaded rod or shaft element 157 of the body 147 and a threaded lock nut 159 has been screwed onto the end of said rod 157 to retain the fixing plate 22*c* and spring 20 captive on the body 147. A horizontal bore 'y' has been drilled in the door frame 'b'; to accommodate the damper spring 20 and rod 157 element of the anchor means 210*c*. A pair of long coarse threaded wood screws 9 have been used to fixedly secure the fixing plate 22*c* to the door frame 'b' and thereby resiliently secure the door frame anchor means 210*c* to the door frame 'b'. The end link 17*a* of a short length of security chain 17 is engaged in the horizontal slot 146 and the locking bolt 160 is in its raised locking position, in which position the bolt 160 has passed through the aperture 17*e* in said link 17*a*, the key 200 has been turned 180 degrees, simultaneously rotating the barrel lock 150, 180 degrees causing the cam 154 defined in the lock body 151 to move the cam follower 170 against the force of the spring 176 closing the gap 178, when the ball bearing 177 is lockingly engaged in the annular recess 164 effectively locking the bolt 160 against vertical movement in the body 147 and the chain 17 against removal from the door frame anchor means 210*c* (see view 'b' of FIG. 45). A plastic bung 156 may be used to close the aperture 145 in the body 147 said bung 156 may also be arranged to limit vertical movement of the locking bolt 160.

Figure 41:
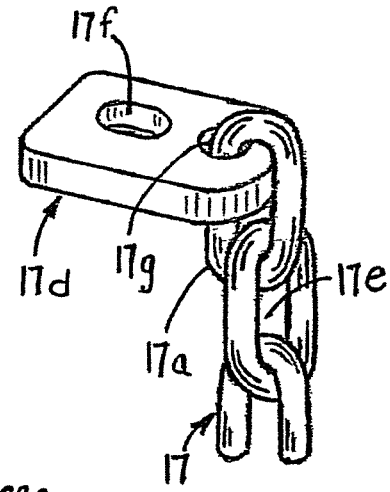
FIG. 41 illustrates a perspective view of a metal plate that may be used as a means to engage the chain with the locking mechanism illustrated in FIGS. 26, 39 and 40.

FIG. 41 illustrates an example of how a metal plate 17*d* provided with a pair of spaced apertures 17*f* and 17*g* may be used as an alternative to the link 17*a* (see also FIG. 47).

FIG. 46 illustrate a rigid or non-damper door frame anchor means 10*z*, the main body 131 differs from that of FIGS. 31 to 36 in that the threaded rod portion 157, spring 20 and lock nut 159 are not provided. A pair of additional generally flat screw fixing limbs 180 and 180*a* are provided on and depend outwards from the top and bottom surfaces 149*d* and 134 respectively of the body 131*a*, said limbs 180 and 180*a* are each provided with a screw fixing aperture 4*a* and 4*b* centrally therein to facilitate fixing the door frame anchor means 10*z* to a door frame 'b', preferably the bottom aperture 4*b* is elongated to facilitate easy alignment of fixing bolts 9*a* and coarse threaded anchor screws 60. The free end of the limb 180*a* is fashioned to form a hook 25 on which to hang the last link, ring or triangle secured to the free end of a guard 17.

The locking bolt 160*a* in this example is shorter and does not require a separate handle 168 and the compression spring 176 has also been eliminated. FIG. 46 shows the locking bolt 160*a* in its lower unlocked position when the wider tapered shoulder 162 is nesting snugly in the chamfer 140 defined in the entry to the aperture 149*b*, gravity will ensure that the bolt 160*a* is always in its lower, unlocked position when the device is not key-locked. In the previous example (as referred to in FIGS. 39 to 44) the compression spring 176 acted to hold the bolt 160 in tension in any vertical position, in this example it is necessary to depress the bolt 160*a* until the accessible end of the bolt 160*a* is flush with the bottom face 149 of the body 131*a*, at which point the ball bearing 177 is aligned with the annular groove 164 such that the key 200 may be turned, which action directly rotates the barrel lock 150, through 180° degrees in the body 131*a*, moving the cam follower 170 to abut the ball bearing 177 (see view 'b' of FIG. 45).

The embodiment of the key lockable door guard assembly shown in FIGS. 47 to 54 differs from that of the previous embodiment shown in FIGS. 39 to 46, in that the main body 147 is partially enclosed by a metal sleeve 190, a short one piece locking bolt 160*a* is provided, and the compression spring 176 is eliminated. The metal sleeve 190 is in the form of a short length of square section metal tube 192.

The key receiving end of the barrel lock 150 a is required to be below the top surface 149*d* of the body 131, as the metal sleeve 190 is preferably a tight or force fit on said main body 131. Preferably, a metal cupped washer may be placed over the top of the barrel lock 150 a to prevent direct contact with the metal sleeve 190, said cupped washer supported on the body 131 a will ensure the said lock 150 a can rotate freely. A modified cam 154 a is defined on the lock body 151 at the end of the lock opposite the key receiving end.

To assemble the locking components in the body 147 (see FIG. 47), the barrel lock 150*a* is first inserted into the aperture 148 when the shoulder 152*a* will locate and be supported on the step 142 in said aperture 148, the cam follower 170*a* and ball bearing 177 are inserted into the horizontal bore 146 such that one end of said cam follower 170*a* abuts the flat portion 154*c* of the cam 154*a* and the ball bearing 177 abuts the other end of the cam follower 170. The bolt 160*a* may now be mounted in the body 147 through the aperture 145 said bolt 160*a* must be centralized in said body 147 (the overall length of the locking bolt 160*a* is slightly less than the height of the body 147. The metal sleeve 190 may now be forced onto the main body 147 to be tightly and fixedly secured thereon. The aperture 193 in the top surface of the body 191 of the sleeve 190 provides key access to the barrel lock 150*a* said aperture 193 is smaller in diameter than the shoulder 152*a* of the lock 150*a*. The smaller aperture 195 defined centrally and toward the front end of said sleeve 190 provides access to the bolt 160*a* via the aperture 145, should the bolt 160*a* not drop down to its unlocked position a pin or the like may be used to remedy the problem. The aperture 194 in the bottom surface is defined centrally and toward the front end of the sleeve 190 is to allow passage of the bolt 160*a* as it is moved and moves between its locking and unlocked positions.

FIG. 47 shows a door frame damper anchor means 10*e* in its key-locked condition showing the locking bolt 160*a* is in its raised position having passed through the aperture 17*f* in the metal plate 17*d*, said metal plate 17*d* being fixedly secured to one end of a short length of guard chain 17, the barrel lock 150*a* has been rotated 180 degrees by means of a key 200 and one end of the cam follower 170*a* is abutting the radial surface 154*b* of the cam 154*a* (i.e. the outside diameter of the barrel lock body 151), as shown on FIG. 48, the other end of said cam follower 170*a* is abutting the ball bearing 177 (see view 'b' of FIG. 49) and said ball bearing 177 is nesting in the annular groove 164 engaging and abutting the bolt 160*a* effectively locking said bolt 160*a* against vertical movement within the body 147 and one end of the guard chain 17 is now fixedly and lockingly secured to said door frame damper anchor means 10*e*. The free end of the short length of guard chain 17, in use, will be releasably secured to a guard plate fixedly attached to a door (for example guard plate 10*g* as illustrated in FIG. 62).

FIG. 49 illustrates the relationship between the ball bearing 177, cam follower 170*a* and cam 154*a*. Drawing 'a' shows the position of the said components when the device is unlocked and prior to the barrel lock 150*a* being rotated 180 degrees relative to the body 147 by means of the key 200 showing a gap 178 between the ball bearing 177 and cam follower 170*a*. Drawing 'b' of FIG. 49 shows the position of said locking components in their second locking position respectively after the barrel lock 150*a* has been rotated 180 degrees relative to the body 147 by means of said key 200, the radial surface 154*b* of the cam 154*a* is abutting one end of the cam follower 170*a* and the ball bearing 177 is abutting the other end of said cam follower 170*a*, the gap 178 has been closed.

FIG. 51 is a front view of the door frame damper anchor means 10*e* of FIG. 47 in its unlocked condition the locking bolt 160*a* is in its lower position when the tapered shoulder 162 on said bolt 160*a* is nesting in the chamfer 140 in the entrance to the aperture 149*b* and the device is ready to receive the chain link 17*a* or metal plate 17*d*, the key 200 is shown engaged in the barrel lock 150*a*.

FIG. 52 shows a rigid non-damper anchor means 10*f* in its locked condition, the bolt 160*a* is in its raised position and the key has been removed from the lock 150*a*, however, the security chain 17 is not attached. In this condition the end of the bolt 160*a* is protruding slightly past the bottom surface of the metal sleeve 190 (see FIG. 47) thus the bolt 160*a* will also act to prevent removal of the sleeve 190 from the body 147.

Figure 53:
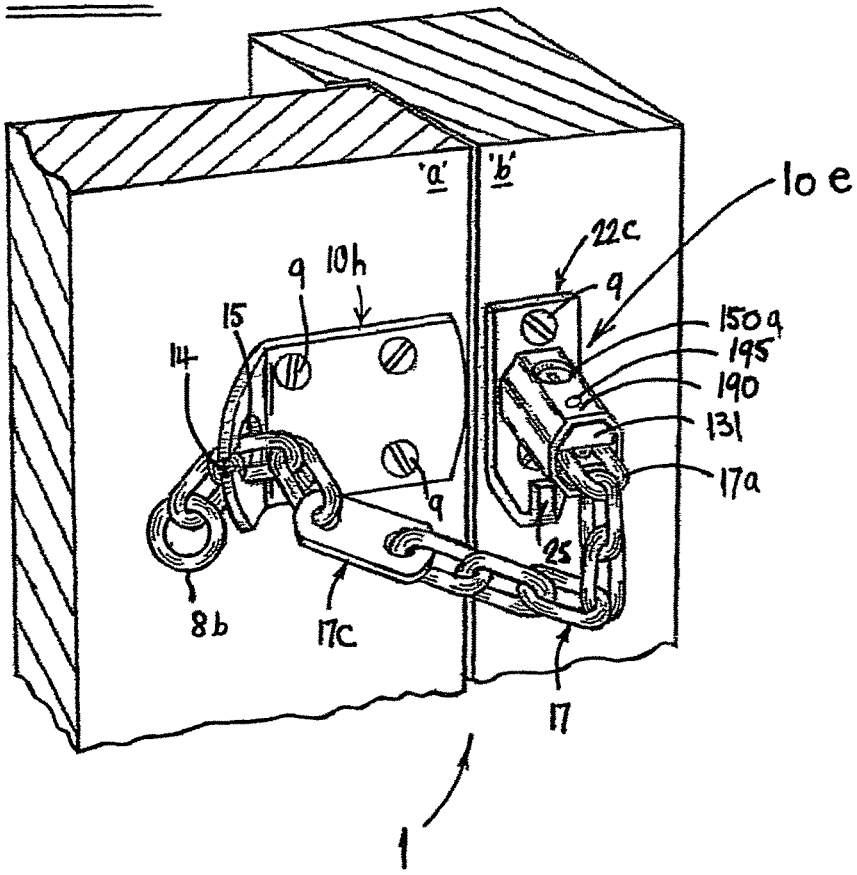
FIG. 53 illustrates a perspective view of a further alternative door guard assembly according to the present invention that utilises a door frame spring damper anchor means and locking mechanism.

FIG. 53 shows the lockable door frame anchor means 10*e* of FIG. 51 as part of a complete door guard assembly (as generally indicated by 1), with the door frame anchor means 10*e* and door guard plate 10*h* fixedly secured to a door 'a' and door frame 'b' respectively. The link 17*a* of the guard chain 17 is fixedly and lockingly secured thereto the chain 17 in conventional manner has a small metal plate 17*c* interconnected midway of its length, said metal plate 17*c* may be passed through the narrow slot 14 in the door guard plate 10*h* which allows the chain to access and locate in the wider slot end portion 15 on the guard plate 10*h*, a metal ring 8*b* is fixedly secured to the free end of the guard chain 17, the ring 8*b* will not pass through the wider slot end portion 15 on the guard plate 10*h*. The chain 17 shown in FIG. 53 is releasably engaged in the door guard plate 10*h* and the door guard assembly (as generally indicated by 1) is operational and on standby. When the door guard assembly is not in use the ring 8*b* locates on the hook 25 on the door frame anchor means 10*e*.

Figure 54:
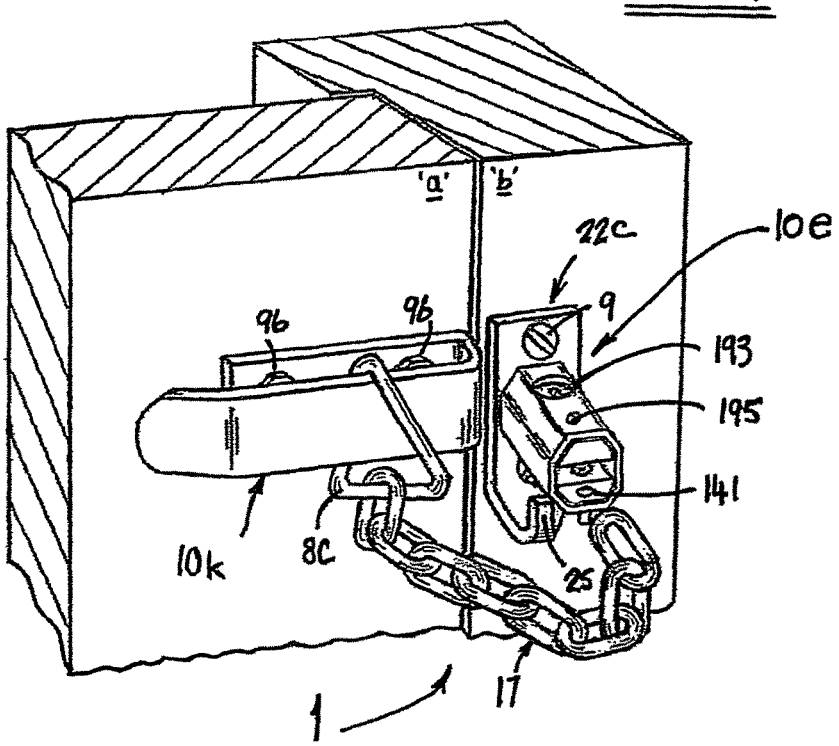
FIG. 54 illustrates a perspective view of a further alternative door guard assembly according to the present invention that utilises a door frame spring damper anchor means and locking mechanism.

FIG. 54 illustrates the lockable door frame anchor means 10*e* of FIG. 51 as part of a complete door guard assembly 1, with the door frame anchor means 10*e* and door guard plate 10*k* (of FIG. 22) fixedly secured to a door 'a' and door frame 'b' respectively. In this example a triangle 8*c* is fixedly secured to the free end of the guard chain 17 said triangle 8*c* is releasably secured on the door guard plate 10*k*. The chain link 17*a* has been released from locking engagement in the door frame anchor means 10*e* by means of a key 200 which would be the case if, for example, a family member or carer had entered the home when the door guard assembly 1 was locked and operational.

Referring now to FIGS. 55 to 59 in which a high security, spring damper door guard assembly 1 is provided, FIG. 55 is a front view showing the door guard assembly 1 in its first inoperative condition when the spring damper enclosure 40*f* which is secured to and suspended from the door frame anchor plate 22*d* by means of a short length of guard chain 17, is engaged in the spring clip 47*b* attached to the door frame 'b'. FIG. 56 is a part cross-sectional view of the tubular spring housing 40*f* which defines fluting 42 at its free end, said fluting 42 acts to anchor the spring housing 40*f* in the door guard plate 550*b*.

The door frame anchor means 22*d* of FIGS. 55 and 56 comprises a rectangular metal fixing plate 22*e* which defines a pair of screw receiving apertures (not shown), adjacent each end thereof, a 'u' shaped metal loop 5*c* is secured centrally and depends outward from said fixing plate 22*d*. One end of a short length of guard chain 17 is secured in the 'u' shaped metal loop 5*c* on said fixing plate 22*d*, the other end of the guard chain 17 is connected to a steel cable 13*a* which is affixed to a spring end closure 26 that is located, in use, within the housing 40*f*, such that the spring 20 absorbs any pulling forces (impacts forces) exerted on the chain 17. A link sized metal plate 17*c* is interposed in the guard chain 17, this metal plate is sized to allow entry of the guard chain 17 through the narrower aperture (52*a*) in the door guard plate into the larger slot end aperture 52*b* in the door guard plate 550*b*.

The door guard plate (as generally indicated by 550*b* and as best illustrated in FIG. 55), comprises a generally rectangular metal plate 551*b* one end of said plate is bent to form a stop face 52, a narrow entry slot aperture 52*a* leads centrally and from the outer edge of the stop face 52 to a larger slot end aperture 52*b*, the diameter of said larger slot end 52*b* is a clearance fit on the outside diameter of the tubular housing 40*f* (i.e. larger slot (aperture) 52*b* is sized to receive the housing 40*f*). The fluting 42 on the free end (not connected to the chain) of the spring housing 40*f* will not pass through the larger slot end aperture 52*b* in the wall 52, thus said wall 52 acts as an abutment or stop for the spring housing 40*f*. The sides of the guard plate 550*b* are also bent and curved inwards to form walls 555*b* that act to support and capture the spring housing 40*f* within the guard plate 550*b*. The base 551*b* of the guard plate 550*b* extends past the walls 555*b* and increases in width to provide a screw fixing surface 551*c* which is provided with a pair of spaced screw fixing apertures 4*a*, one at each end thereof. The screw fixing surface 551*c* also acts as a door edge protector. Additional screw fixing apertures are defined in the base 551*b* of door guard plate 550*b*.

FIG. 56 is a partial cross sectional view best illustrating the spring housing 40*f* and the relationship of the components therein. The components of the spring housing 40*f* comprise a compression spring 20, a short length of steel cable 13*a*, a bearing washer 53, a ferrule 38 and a spring end closure 26 (as previously described and shown in relation to FIG. 25).

The link 17*a* of the chain 17 is prevented from entering the spring housing 40*f* by the 'rolled' over end 43*a* on said housing 40*f*, the strong damper spring 20 may be slightly loaded against the bearing washer 53 thereby loading the link 17*a* against the 'rolled' end 43*a* of the spring housing 40*f* Any force applied to the door 'a' will cause the guard chain 17 to pull on the steel cable 13*a* which is secured to the spring end closure 26 via the ferrule 38, the said spring end closure 26 will compress the spring 20 which will absorb the force.

In use, to place the door guard assembly 1 (as shown in FIG. 55) in its second operative or standby, simply remove the spring damper housing 40*f* from the spring clip 47*b* and raise it to the horizontal so that the metal plate 17*c* on the guard chain 17 is aligned with the slot 52*a* in the wall 52. Then pass said metal plate 17*c* through the slot 52*a* and draw the guard chain 17 to the left through the aperture 52*b* while simultaneously guiding the spring housing 40*f* into the guard plate 550*b* and within the supporting walls 555*b* until the fluted end 42 of the housing 40*f* abuts the outer surface of the guard plate wall 52 and the door guard components assume their second operative or standby position (as is shown in FIG. 57 for an alternative embodiment). The door guard assembly 1 is now operational, the door frame anchor means is releasably secured to the door guard plate 550*b*. The door 'a' may now be opened 'on guard chain' for inspection of a caller.

When a caller comes to the door 'a', the door may be opened a small amount (the length of the chain less the thickness of the door 'a') for permitted inspection of the caller but unwanted entry is prevented. After inspection the door 'a' must be closed to permit removal of the spring housing 40*f* from the door guard plate 550*b* to allow the door 'a' to be opened fully.

All pressure or impact applied to the door 'a' by a would-be intruder when the door guard assembly is in use will be absorbed/cancelled out by the damper spring 20 thereby protecting the anchor points on the door 'a' and door frame 'b' and also preventing possible damage to said door and frame.

It is to be understood, that the key lockable door frame anchor means 10*z* and 10*f* which are described and illustrated in the embodiment of FIGS. 39 to 54 may be used as an alternative to the door frame fixing plate 22*d*.

In the embodiments shown in FIGS. 57 and 58, the door frame fixing plate 22*d* is identical to that of FIG. 55. The spring enclosure 40*e* is suspended from the U shaped loop 5*c* on the fixing plate 22*d*. The tubular spring enclosure 40*e* in this example has both its ends 43 and 43*a* 'rolled' inwards to retain the spring 20 and compressing plate 8*e* captive therein (see FIGS. 26 and 29 for views of the compressing plate 8*e*).

To assemble the spring enclosure 40*e*; with one end of the guard chain 17 engaged in and suspended from the loop 5*c* on the fixing plate 22*d*, the end 43*a* of the spring enclosure 40*e* is 'rolled' inwards and said housing 40*e*, 'rolled' end first, is then loaded onto the free end of the guard chain 17. With the free end of the guard chain 17 now protruding outwards from the end 43 of the spring enclosure 40*e*, the spring 20 is then loaded onto the guard chain 17 and moved inside the spring enclosure 40*e* to abut the 'rolled' inwards end 43*a*, a spring compressing plate 8*e* is then engaged in the last link 17*a* on the free end of the guard chain 17, said compressing plate 8*e* is then closed to retain it captive on the free end of the guard chain 17. The other end 43 of the spring enclosure 40*e* is then 'rolled' inwards to retain the spring 20 and compression plate 8*e* captive within the spring enclosure 40*e*. The door frame anchor means is now fully assembled and the spring housing 40*e* is elastically connected to the fixing plate 22*d*, such that in use the spring 20 absorbs any pulling force applied to the chain 17 due to an impact force being applied to a door to which a door guard assembly as illustrated in FIGS. 57 and 58 is affixed.

An alternative door guard plate 550 is provided for this example which acts as an enclosure and an abutment means for the spring enclosure 40*e*. The door guard plate 550 comprises a generally rectangular plate 551 a portion of one end of said plate is bent form a stop face or abutment 52, a narrow entry slot 52*a* leading centrally and from the outer edge of the stop face 52 to a larger slot end or slot end aperture 52*b*, the slot 52*a* and aperture 52*b* allow the guard chain 17 to enter and engage the guard plate 550 when the link sized metal plate 17*c* is passed through the slot 52*a*. A portion of both sides of the guard plate 550 are bent and curved inwards at numeral 56*b* to form side walls 555 to support and captivate the spring enclosure 40*e* in the door guard plate 550. A number of screw fixing apertures 4*a* in the fixing base 551 of the guard plate 550 facilitate it being secured with screws 9 to a door 'a'.

In use to place the door guard assembly 1 in its second operative or standby position, simply remove the tubular spring enclosure 40*e* from the spring clip 47*a* and raise it to the horizontal so that the metal plate 17*c* on the guard chain 17 is aligned with the slot 52*a* in the guard plate 550, pass the plate 17*c* through said slot 52*a* and draw the guard chain 17 to the left and through the large aperture or slot end 52*b* while simultaneously guiding the spring enclosure 40*e* into the guard plate 550 and within the supporting walls 555 until the front end 43*a* of the spring enclosure 40*e* abuts the stop face 52 and the door guard components assume their second operative or standby position best illustrated in FIG. 57, when the door guard assembly 1 is now operational, the door frame anchor means is releasably secured to the door guard plate 550. The door 'a' may now be opened 'on guard chain' for inspection of a caller.

FIG. 58 is a perspective view of the door guard plate 550. The flat rectangular plate 21 as shown in FIG. 57 is provided to protect the edge of the door 'a'.

It will be understood by the skilled man that, that the key lockable door frame anchor means 10*z* and 10*f* which are described and illustrated in the embodiment of FIGS. 39 to 54 may be used as an alternative to the door frame fixing plate 22*d*.

Referring now to FIG. 59, in this example a rectangular metal plate 46 is fixedly secured longitudinally to the side of the spring enclosure 40*a*, the sides 46*a* of the metal plate 46 extend outward of the spring enclosure 40*a* on each side thereof to provide a pair of flanges 46*b*, said flanges 46*b* respectively to be slidably engaged with a pair of channels 3*c* defined by the bent over sides 2*c* of the door guard plate (as generally indicated by 2*b*).

An alternative door guard plate 2*b* is provided in this example and comprises a generally rectangular strip of metal the side edges 2*c* of which have been folded over at 180 degrees to form a channel 3*c* on each side of the plate 2*b* said pair of channels 3*c* are provided to receive the pair of flanges 46 respectively which depend from each side of the tubular spring enclosure 40*a*, and by means of which said spring enclosure 40*a* is slidably mounted within the door guard plate 2*b* within said channels 3*c*. Spaced screw fixing apertures 4*a* are defined centrally and longitudinally aligned in said guard plate 2*b* which allow it to be fixedly secured to the face of a door with screws 9. The apertures 4*b* at the front end of the plate 2*b*, in use, receive a pair of dome or large headed screws, not shown, said dome headed screws act as abutment stops for the spring enclosure 40*a* within the plate 2*b*. Alternatively, as illustrated in FIG. 59, the apertures 4*b* may be used to fix a stop plate 4*c* within the guard plate 2*b* to act as an abutment stop for the spring enclosure 40*a* said stop plate 4*c* may be magnetic.

The door frame fixing plate 22*d* is identical to that previously shown in FIG. 55. The spring enclosure 40*a* is suspended on the guard chain 17 from the U shaped loop 5*c* on said fixing plate 22*d*. Both ends 43 and 43*a* respectively of the spring enclosure 40*a* are 'rolled' inwards to retain the spring 20 and compressing plate 8*e* captive therein (see FIG. 59). The spring enclosure 40*a* is assembled as previously described with reference to FIGS. 57 and 58.

The spring enclosure 40*a* when not in use is engaged in its stowage holster 2*d* which is attached to the door frame 'b'. To place the door guard assembly 1 in its second operative or standby position, simply lift the tubular spring enclosure 40*a* from its stowage holster 2*d* (the storage holster is a suitably shaped and sized piece of the door guard plate 2*b*) and slidably engage it in the door guard plate 2*b* and move said enclosure 40*a* to the front of said door guard plate 2*b* to abut the stop plate 4*c* (see FIG. 59).

It is to be understood, that the key lockable door frame anchor means 10*e* and 10*f* which are described and illustrated in the embodiments shown in FIGS. 39 to 54 may be used as an alternative to the door frame fixing plate 22*d* as previously described.

FIGS. 60 to 63 illustrate a door guard assembly 1*u* which provides for varying degrees of door opening, the amount the door is allowed to open is determined by which link on the guard chain 17 is selected to engage the guard plate 10*g*, selecting the end link on the free end of the guard chain 17 would be the maximum the door 'a' is allowed to open. FIG. 61 illustrates a perspective view of the door guard plate 10*g*. In FIG. 63 the fourth link from the end of the free end of the guard chain 17 is illustrated engaging the door guard plate 10*g*.

Reference is now made to the embodiments shown in FIGS. 60 to 63, wherein FIG. 60 is a front view showing a complete door guard assembly (as generally indicated by 1*u*) fixedly secured to a door 'a' and door frame 'b' and in its first inoperative condition. The door frame anchor means 10*u* shown in FIG. 60 does not incorporate a spring damper element. The spring damper, door frame anchor means shown in FIGS. 28 and 35 may be used with the door guard plate 10*g* of this embodiment.

The door frame fixing bracket (as generally indicated by 22*e*) shown in FIG. 60 comprises a metal bracket in the form of a channel (i.e. a base section 652 and two parallel walls 652*a*), the side walls 652*a* of the channel being at an angle of approximately 90 degrees to the base 652. The top portions of the walls 652*a* have been bent inwards to provide means for an anchor point for a link 17*a* on a length of guard chain 17. An aperture (not shown) is provide in the top portions of each wall 652*a*, the aperture being located centrally and adjacent the outer edges respectively of the top portions of each wall 652*a*. The apertures receive a pivot pin 53 which passes through the aperture 17*e* in said link 17*a*, the ends of said pivot pin 53 being peened over to fixedly and pivotally secure one end of the guard chain 17 to the door frame anchor bracket 22*e*.

The base 652 of the bracket 22*e* extends beyond the channel walls 652*a* at each end of the bracket 22*e* in order to accommodate screw fixing apertures 4*a* and 4*b*. The aperture 4*b* defined in the bottom end of the bracket 22*e* is an elongated aperture to facilitate easy alignment of a pair of fixing bolts 9*a* and their associated coarse threaded anchor screws 60 respectively.

The bottom end 652*d*, in use, of the base 652 is longer than the top end 652*d* and the lower portion of the bottom end of the base 652 is bent to provide a hook 25 on which to hang an end link 17*a* of the chain 17 (or alternatively on which to hang a ring 8*b* or triangle 8*c* secured to the free end of a guard chain 17).

The door guard plate (as generally indicated by 10*g*) as illustrated in FIG. 60, comprises a short piece of metal channel further comprising extended flanges 114 that are provided with screw fixing apertures 4*a* for fixedly securing said guard plate 10*g* to a door 'a'. The main body or base 115 of the channel defines a slot (as generally indicated by 14) located centrally and transversely therein leading from the back end 14*x* of the guard plate 10*g* to a slot end 14*a* close to the front of the guard plate 10*g*. The slot 14 facilitates entry and engagement of links or a link of a guard chain 17 to the door guard plate 10*g* to releasably secure/engage the free end of the guard chain 17 to the guard plate 10*g*. The slot 14 is located at the end of the guard plate 10*g* that is furthest from the door jamb. The slot 14 is slightly wider in diameter than the diameter of the wire from which the chain links are formed, this ensures that a chain link can only pass sideways through the narrow slot 14 (such that the next link of the chain that is located within the body of the door guard plate acts as a stop) thus providing an interlock between the chain 17 and the door guard plate 10*g*. A number of different links on the free end of the chain 17 may be engaged (singularly) with the slot 14 to releasably secure the guard chain 17 to the guard plate 10*g*; individual links of the chain directly engaging the guard plate to provide varying degrees of selective and secure limited opening of a door 'a' for inspection purposes (i.e. the length of the chain restricts the amount by which the door may be opened). Each of the side walls 116 is provided with an opposing aperture 4*c* and 4*d* close to the back end 14*x* of the guard plate 10*g*, said apertures 4*c* being located to receive a locking pin 29 which is used to lock the guard chain 17 in the door guard plate 10*g* when the door guard is operational. Preferably, the locking pin 29 is fabricated from a suitable plastic material and comprises a body 29*a*, a head 29*b* which has a slightly larger diameter than the body 29*a*, as shown on FIG. 62. The other end of the locking pin 29 defines a small annular rib 29*c* adjacent its end 29*e*, said annular rib 29*c* makes the locking pin 29 a force fit on assembly into the aperture 4*c*, or alternatively 4*d*, and once assembled said pin 29 will remain captive therein unless force is applied to remove it. The locking pin 29, in use, will be engaging both apertures 4*c* and 4*d* and thereby be fully supported. It will be appreciated by the skilled man that a spring damper door frame anchor plate of the type illustrated in FIGS. 22 to 24 may be used with the door guard plate 10*g* as shown in FIGS. 62 and 63.

In use, doors open either to the right or left, therefore, the locking pin 29 should not be engaged in the door guard plate 10*g* until it is determined whether the door 'a' opens to the right or left. Engaging a link of the guard chain 17 in the narrow slot 14 in the door guard plate 10*g* and moving the chain to the end 14*a* of said narrow slot will allow the door 'a' to be opened a small amount for permitted inspection of a caller but prevents unwanted entry (see FIG. 63). After inspection the door 'a' must be closed to permit removal of the chain 17 from the guard plate 10*g* to allow the door 'a' to be opened fully.

Engaging the first link on the free end of the chain 17 in the narrow slot 14 will allow the door 'a' to be opened the maximum for 'inspection', alternatively engaging the fourth link from the end of the chain 17 in the narrow slot 14 will considerably reduce the amount the door is allowed to open for 'inspection'. The use of individual links to lock the chain 17 onto the door guard plate 10*g* provides for varying degrees of limited opening of a door 'a' (see FIG. 62). When the door guard is not in use the end link 17*a* on the guard chain 17 will be engaged on the hook 25 on the fixing bracket 22*e* (see FIG. 60).

A key locking, spring damper, door frame anchor means 10*e* is illustrated in FIG. 62, it is shown working in conjunction with the door guard plate 10*g*. The door guard assembly of FIG. 62 is shown in its second operative (or standby) condition. The key locking, spring damper, door frame anchor mean 10*e* is described in detailed above with reference to FIGS. 47 to 54, in which the spring damper element is recessed into the door frame 'b'.

FIGS. 64 and 65 are views of a rigid, non-damper door frame anchor means 22*e* that may be used in conjunction with the spring damper door guard plate 10*v* previously described and illustrated in FIGS. 34 to 38. The rigid door guard plates 10*g*, 10*h* and 10*k* previously described and illustrated may also be used in conjunction with the rigid door frame anchor bracket 22*e*.

The FIGS. 64 and 65 illustrate a door frame anchor bracket 22*e* already described fully in the previous embodiment illustrated in FIGS. 60 to 63. FIG. 64 is a side view of the anchor bracket 22*e* with the preferred fixing means, the coarse threaded anchor screws 60 and associated threaded bolts 9*a*. The chain link 17*a* is fixedly secured to the bracket 22*e* by the pivot pin 53. A pair of apertures 4*a* and 4*b* respectively are provided at each end of the bracket 22*f*, the aperture 4*b* provided in the bottom end 652*d* of the bracket 22*f* is an elongate aperture, which facilitates alignment of the threaded bolts 9*a* respectively with their associated coarse threaded anchor screws 60 when fixing the bracket 22*f* to a door frame 'b'. FIG. 65 is a front view of the anchor bracket 22*e* clearly showing the link 17*a* on one end of the guard chain 17 pivotally secured to the anchor plate 22*e*, the free end of the guard chain 17, in use, to be releasably secured to a guard plate fixedly secured to a door 'a'. The door frame anchor bracket 22*e* may be used in conjunction with the spring damper door guard plate 10*d* described and illustrated in FIGS. 26 to 38. The rigid door guard plates 10*g*, 10*h* (as shown on FIG. 53) and 10*k* (as shown on FIG. 53) may also be used in conjunction with the rigid door frame anchor bracket 22*e*.

FIG. 66 illustrates another example of a door frame anchor bracket 22*f* comprising a narrow strip of metal comprising a U shaped recess or bend (generally indicated by 4*e*) midway of its length. The recess 4*e* is provided to accommodate and allow free movement of a chain link 17*a*, ring 8*b* or triangle 8*c* secured to one end of a guard chain 17, when the door frame anchor bracket 22*f* is attached to a door frame in use. A pair of apertures 4*a* and 4*b* respectively are provided at each end of the bracket 22*f* The aperture 4*b* provided in the bottom end of the bracket 22*f* may be provided in the form of an elongated aperture (not illustrated), which facilitates alignment of the threaded bolts 9*a* respectively with their associated coarse threaded anchor screws 60 when fixing the bracket 22*f* to a door frame 'b'. The door frame anchor bracket 22*f* may be used in conjunction with the spring damper door guard plate 10*v* as previously described and illustrated in FIG. 34 (and also with the non-damper door guard plate 10*g* in FIGS. 60 and 62). The rigid door guard plates 10*g*, 10*h* and 10*k* may also be used in conjunction with the rigid door frame anchor bracket 22*e*.

FIG. 67 is a perspective views of a preferred fixing means for securing the door frame anchor means of the invention to a door frame 'b' said fixing means provides for an enhanced, superior and secure door guard assembly.

FIG. 67 provides perspective views respectively of a coarse threaded anchor screw 60, threaded bolt 9*a*, cross dowel nut dl and drive bolt b1. The coarse threaded anchor screw 60 comprises a body 61 comprising a coarse thread 62. The back end of the screw 60 is provided with an internal threaded bore 63 to receive the threaded bolt 9*a*, a screwdriver slot 64 is also provided which spans the threaded bore 63. The cross dowel nut d1 is an alternative anchor means for a door guard plate and requires a much longer threaded bolt 9*a* (as previously illustrated in FIG. 23). The drive bolt b1 is a short, standard threaded bolt with a large hexagonal head, its only purpose is to be used to drive the coarse threaded anchor screw 60 into the pre-drilled aperture 'y' in a door frame 'b', the bolt b1 may then be discarded. A large screwdriver or an electric screwdriver may be used to drive the anchor screw 60 into the predrilled pilot aperture 'y'.

The spring damper elements of the door guard assemblies 1, respectively, are not utilised in normal use, they only comes into play when a would-be intruder attempts forced entry.

It will be appreciated by the skilled man that various modifications may be made to the door guard assemblies described herein. For example the use of various door frame anchor means (as disclosed herein) with various door guard anchor means (as disclosed herein) to provide door guard assemblies with varying characteristics are possible, i.e. it is possible to mix and match suitably adapted door frame anchor means and door guard plates. For instance the spring damper door guard plates illustrated in FIGS. 28 to 37 may be used with the locking mechanism shown in respect of FIG. 26. Similarly the spring damper door assembly shown in FIG. 26 may be used with the non-locking door frame anchor means illustrated in FIGS. 28 to 37.

The term releasably engaged is used to indicate the fact that the components of the device have been engaged with each other whilst the device is in use, but that the components may be subsequently disengaged by a user of the device, but not by a would-be intruder.

The terms "standby" or "operational" are used herein to indicate that the door assembly concerned is in its ready to use condition, i.e. only limited opening of the door will be allowed due to the separate components of the door guard assembly (affixed to the door frame and the door) being engaged with each other as the door is opened.

The invention claimed is:

1. A door guard assembly comprising:

a first part that is attachable to a door;

a second part that is attachable to a door frame;

a rigid elongate member attached to the second part, wherein the second part or the rigid elongate member further comprises a damper;

a slidable plate located on the first part and comprising an aperture at an end of the slidable plate, wherein:

when the door is in a closed position and the slidable plate is slid into an operating position, the aperture is positioned to engage an outer surface of the rigid elongate member as the door is opened to a partially opened position from the closed position such that:

the aperture and the rigid elongate member thereby engage to limit the opening of the door beyond the partially open position, and the damper is coaxially aligned with at least part of the rigid elongate member when the rigid elongate member is in an engaged position, engaging with the aperture, to limit the opening of the door beyond the partially open position and the damper absorbs an impact force when the impact force is applied to the door and acts in a substantially longitudinal direction with respect to an axis of the rigid elongate member.

2. A door guard assembly as claimed in claim 1 wherein the damper comprises one or more resiliently deformable body/bodies.

3. A door guard assembly as claimed in claim 1 wherein the damper comprises one or more resiliently deformable body/bodies and at least one of the one or more resiliently deformable body/bodies is/are springs or body/bodies comprised of resiliently deformable material.

4. A door guard assembly as claimed in claim 1 wherein the damper comprises one or more resiliently deformable body/bodies and at least one of the resiliently deformable body/bodies is/are helical spring(s) or body/bodies comprised of a resiliently deformable material and wherein the helical spring(s) is/are in the form of a tension coil spring(s) or a compression spring(s).

5. A door guard assembly as claimed in claim 1 wherein the damper is located within the door frame.

6. A door guard assembly as claimed in claim 1 wherein the damper comprises one or more resiliently deformable body/bodies and at least one of the resiliently deformable body/bodies is/are springs, or body/bodies comprised of resiliently deformable material, and wherein the elongate member is an elongate housing for the damper.

7. A door guard assembly as claimed in claim 1 wherein the damper comprises one or more resiliently deformable body/bodies and at least one of the resiliently deformable body/bodies is a tension coil spring, or a body comprised of resiliently deformable material, and wherein the assembly further comprises a means to limit the amount by which the damper may be extended when the damper is the tension coil spring.

8. A door guard assembly as claimed in claim 1 wherein the elongate member is pivotally connected to the door frame by its attachment to the second part and the first part is connected to the door by a fixing means.

9. A door guard assembly as claimed in claim 1 wherein the elongate member is pivotally mounted to the door frame by its attachment to the second part such that it rises in a generally vertical direction as the door is opened to the partially opened position when the slidable plate is in the operative position, due to the engagement of the aperture with the outer surface of the elongate member.

10. A door guard assembly as claimed in claim 1 wherein the aperture comprises a first aperture located at the end of the slidable plate, the first aperture being adjacent a second aperture that is larger than the first aperture, the second aperture being sized to receive and engage the outer surface of the elongate member.

11. A door guard assembly as claimed in claim 10 wherein the elongate body comprises a stop that cannot pass through the second aperture.

12. A door guard assembly as claimed in claim 1 wherein the elongate member is pivotally connected to the door frame by its attachment to the second part and the first part is connected to the door by a fixing means, and the damper is a compression coil spring that is pivotally mounted to the second part by a pivot bolt, the pivot bolt comprising a screw thread by which the elongate member is attached to the second part.

13. A door guard assembly as claimed in claim 1 wherein damper comprises one or more resiliently deformable body/bodies and at least one of the resiliently deformable body/bodies is/are springs, or body/bodies comprised of resiliently deformable material, wherein the resiliently deformable material is an elastomeric material.

14. A door guard assembly as claimed in claim 1, wherein the aperture in the slidable plate comprises a first aperture located at the end of the slidable plate and a second aperture adjacent the first aperture that is larger than the first aperture, wherein the first aperture connects the second aperture to the end of the slidable plate, such that:

when the door is in the closed position, the slidable plate is slidable into the operating position.

15. A kit of parts comprising a door guard assembly as claimed in claim 1 wherein the damper is a helical spring.

16. A kit of parts as claimed in claim 15 further comprising an elongate housing for the helical spring.

* * * * *